US007185563B2

(12) United States Patent
Kozak et al.

(10) Patent No.: US 7,185,563 B2
(45) **Date of Patent: *Mar. 6, 2007**

(54) IMPACT DRIVER AND FASTENER REMOVAL DEVICE

(75) Inventors: Ira M. Kozak, Chicago, IL (US); Burton Kozak, Chicago, IL (US)

(73) Assignee: Combined Products Co. #1, Inc., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/323,129

(22) Filed: Dec. 30, 2005

(65) Prior Publication Data

US 2006/0101950 A1 May 18, 2006

Related U.S. Application Data

(63) Continuation of application No. 10/844,795, filed on May 12, 2004, now Pat. No. 7,007,573.

(51) Int. Cl.
*B25B 13/50* (2006.01)
*B25B 23/10* (2006.01)
*B25B 23/08* (2006.01)
*B25B 23/00* (2006.01)

(52) U.S. Cl. ..... 81/53.2; 81/441; 81/460; 81/461

(58) Field of Classification Search ..... 81/53.2, 81/441, 460, 461; 30/167, 168
See application file for complete search history.

(56) References Cited

U.S. PATENT DOCUMENTS

| | | | | |
|---|---|---|---|---|
| 410,780 | A * | 9/1889 | Cahn | 408/206 |
| 906,040 | A | 12/1908 | Lucas | 81/120 |
| 1,041,440 | A | 10/1912 | Decker | 411/379 |
| 2,750,821 | A | 6/1956 | Hilsinger | 81/3.5 |
| 3,161,090 | A * | 12/1964 | McLellan | 81/53.2 |
| 4,572,035 | A * | 2/1986 | Eisenhauer | 81/53.2 |
| 5,551,320 | A * | 9/1996 | Horobec et al. | 81/53.2 |
| 5,737,981 | A * | 4/1998 | Hildebrand | 81/53.2 |
| 5,906,146 | A | 5/1999 | Arlen | 81/53.2 |
| 6,047,620 | A * | 4/2000 | Kozak et al. | 81/441 |
| 6,598,498 | B1 * | 7/2003 | Pigford et al. | 81/53.2 |
| 6,807,880 | B1 | 10/2004 | Brian et al. | 81/53.2 |
| 7,007,573 | B2 * | 3/2006 | Kozak et al. | 81/53.2 |
| 2004/0079202 | A1 | 4/2004 | Chrzanowski | 81/53.2 |

* cited by examiner

*Primary Examiner*—Joseph J. Hail, III
*Assistant Examiner*—Bryan Muller
(74) *Attorney, Agent, or Firm*—Cherskov & Flaynik

(57) ABSTRACT

A fastener impact driver device includes a fastener engagement member having a plurality of projections disposed about a lower portion that engages a corresponding peripheral portion of a fastener. The device further includes a positioning member having an upper portion that ultimately receives a force thereupon, and a lower portion that engages a cooperating upper portion of the fastener engagement member whereby a force such a hammer strike is imparted upon the upper portion of the positioning member to drive the projections of the fastener engagement member into the head of the fastener without damage of the fastener engagement member, whereupon the positioning member is removed from the fastener engagement member and a hand tool is removably secured to the fastener engagement member to impart rotary motion to the member and the fastener thereby removing the fastener from or urging the fastener into a workpiece.

22 Claims, 25 Drawing Sheets

IMPACT DRIVER AND FASTENER REMOVAL DEVICE

CLAIM FOR PRIORITY

The present application is a Continuation of application Ser. No. 10/844,795 filed May 12, 2004, now U.S. Pat. No. 7,007,573 the complete subject matter of which is incorporated herein by reference in its entirety.

BACKGROUND OF THE INVENTION

1. Field of the Invention

The present invention relates generally to fastener extraction devices and, more particularly, to fastener impact devices for extracting a fastener from or inserting a fastener into a workpiece by striking the device with a hammer to force grasping projections into the head of the fastener, then removably securing a hand tool to the device to impart rotary motion to the device thereby rotating the fastener in a predetermined direction.

2. Background of the Invention

Fastener extraction devices are well known and are generally designed to remove broken stud bolts and to extract one-way fasteners by the device with a rotary drive tool such as a ratchet. However, few of the prior art fastener extraction devices are designed to receive a strike from an impact tool such as a hammer to force "biting" edges or projections of the extraction device into the head of the fastener to allow the extraction device to "grasp" the fastener head and forcibly rotate the head in a predetermined direction with a rotary drive tool. Examples of prior art fastener extraction designs that can receive a forceful blow from an object such as a hammer are illustrated in U.S. Pat. Nos. 4,875,289; and 4,026,338. Further, the prior art impact designs include projections that are limited in number, that engage the fastener head at less than optimum portions and that are designed to "assist" a primary rotational driver (the blade of a screwdriver) to rotate the fastener.

A problem with the prior art impact extraction designs is that the edges or projections are to few in number or are imbedded sufficiently deep into the fastener head and ultimately "break free" from the fastener head before sufficient rotational force is generated to extract the fastener from the workpiece. Another problem with the prior art designs is that the projections cannot be driven sufficiently deep into the fastener head without damaging the device with a forceful hammer strike. Yet another problem with the prior art designs is that a deformed or damaged fastener head may include portions that cannot be engaged by corresponding projections from the extraction device resulting to few projections engaging the fastener head to provide sufficient rotational force to remove or insert the fastener from or into the workpiece.

A need exits in the art for a fastener impact driver device that includes edges and/or projections sufficient in quantity and design to grasp and rotate a fastener head. Further, the device must be capable of receiving forceful impact without being damaged. Also, the device must be sufficiently adjustable to cause all projections extending therefrom to engage corresponding portions of the fastener head thereby promoting the rotation of the fastener or from a workpiece.

SUMMARY OF THE INVENTION

It is an object of the present invention to provide a fastener impact driver device thereby overcoming many of the disadvantages of the prior art.

A principal object of the present invention is to provide a fastener impact driver device that removes or inserts a fastener into a workpiece. A feature of the device is a fastener engagement member with projections that insert into and "grasp" a peripheral portion of a fastener head. An advantage of the device is that it transfers rotary motion from a hand tool to the fastener head.

Another object of the present invention is to provide a device capable of receiving a hammer strike thereupon. A feature of the device is a positioning member that is axially aligned with and removably inserted into the fastener engagement member via a protuberance extending from the positioning member and snugly inserting into a recess in the fastener engagement member. An advantage of the device is that the positioning member "protects" the fastener engagement member from being deformed or otherwise damaged by hammer strikes. Another advantage of the device is that the positioning member transfers the driving force of the hammer to the fastener engagement member thereby forcing the projections of the fastener engagement member to be driven into the fastener head. Still another advantage of the device is that the positioning member is removable from the fastener engagement member to allow a hand tool to be inserted into the recess in the fastener engagement member and impart rotary motion thereupon to ultimately rotate the fastener head to insert the fastener into or extract the fastener from a workpiece.

Still another object of the present invention is to provide alternative projection configurations. A feature of the device is a selection of fastener engagement members that have varying projection configurations that includes linear or arcuate. An advantage of the device is that rotary motion imparted upon the fastener head by a fastener engagement member may be increased by using an arcuate projection configuration.

Yet another object of the present invention is to provide a device that protects the fingers of a user of the device. A feature of the device is an extension that is integrally joined to a lower portion of the positioning member and extends around an upper peripheral portion of the fastener engagement member. An advantage of the device is that the fingers of the user will not be pinched between the bottom wall of the positioning member and a top wall of the fastener engagement member.

Another object of the present invention is to provide an alternative fastener engagement member. A feature of the device is a lower annular planar surface that includes pyramid configured projections extending therefrom which cooperate with the peripheral projections to increase the grasp of the fastener engagement member upon the fastener head. An advantage of the device is that peripheral and central portions of the fastener head are grasped and rotated by the fastener engagement member thereby increasing the quantity of rotary force imparted upon the fastener to ultimately insert or extract the fastener into or from a workpiece.

Another object of the present invention is to provide an alternative fastener impact driver device. A feature of the device is a first fastener engagement member that includes an aperture axially disposed therethrough. An advantage of the device is that a damaged or deformed fastener head that ordinarily would not be engaged by a single fastener engagement member can ultimately be engaged by a second fastener engagement member that is independent of the first fastener engagement member.

Another object of the present invention is to provide an alternative fastener impact driver device having first and second fastener engagement members that engage cooperating peripheral and central portions of a fastener head. A feature of the device is projections protruding from lower portions of the first and second fastener engagement members that independently grasp respective peripheral and central portions of the fastener head when a hammer is struck upon a positioning member disposed upon a top wall of the second fastener engagement member. An advantage of the device is that rotary motion is imparted upon peripheral and central portions of a deformed fastener head to extract or insert the fastener head from or into a workpiece.

Another object of the present invention is to provide an alternative fastener impact driver device capable of receiving a hammer strike without damaging the first and second fastener engagement members. A feature of the device is a positioning member that is axially aligned with and removably inserted into the second fastener engagement member via a protuberance extending from the bottom wall of the positioning member and snugly inserting into a recess in the top wall of the second fastener engagement member. An advantage of the device is the positioning member is readily removed from the top wall of the second fastener engagement member to allow a hand tool to be inserted in the recess in the top wall thereby providing rotary motion to the first and second fastener engagement members to ultimately rotate the fastener head to insert the fastener into or extract the fastener from a workpiece.

Briefly, the invention provides a fastener impact driver device comprising a fastener engagement member having a plurality of projections disposed about a lower portion that engages a peripheral portion of a fastener, and a positioning member having an upper portion that ultimately receives a force thereupon, said positioning member having a lower portion that engages a cooperating upper portion of said fastener engagement member whereby a force imparted upon said upper portion of said positioning member ultimately forces said projections of said fastener engagement member into the fastener whereupon said positioning member is removed from said fastener engagement member and a hand tool is removably secured to said fastener engagement member to impart rotary force to said fastener engagement member thereby removing the fastener from or inserting the fastener into a workpiece.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
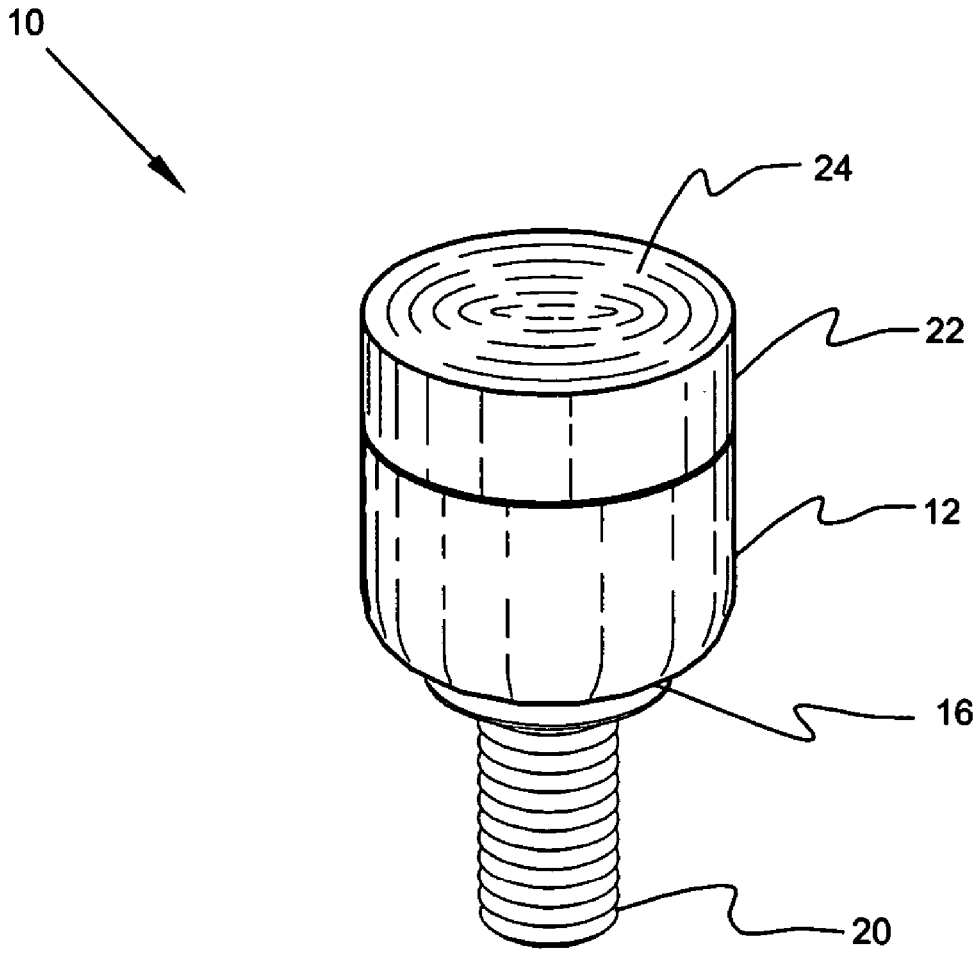
FIG. 1 is a perspective view of a fastener impact driver device, in accordance with features of the present invention.
Figure 2:
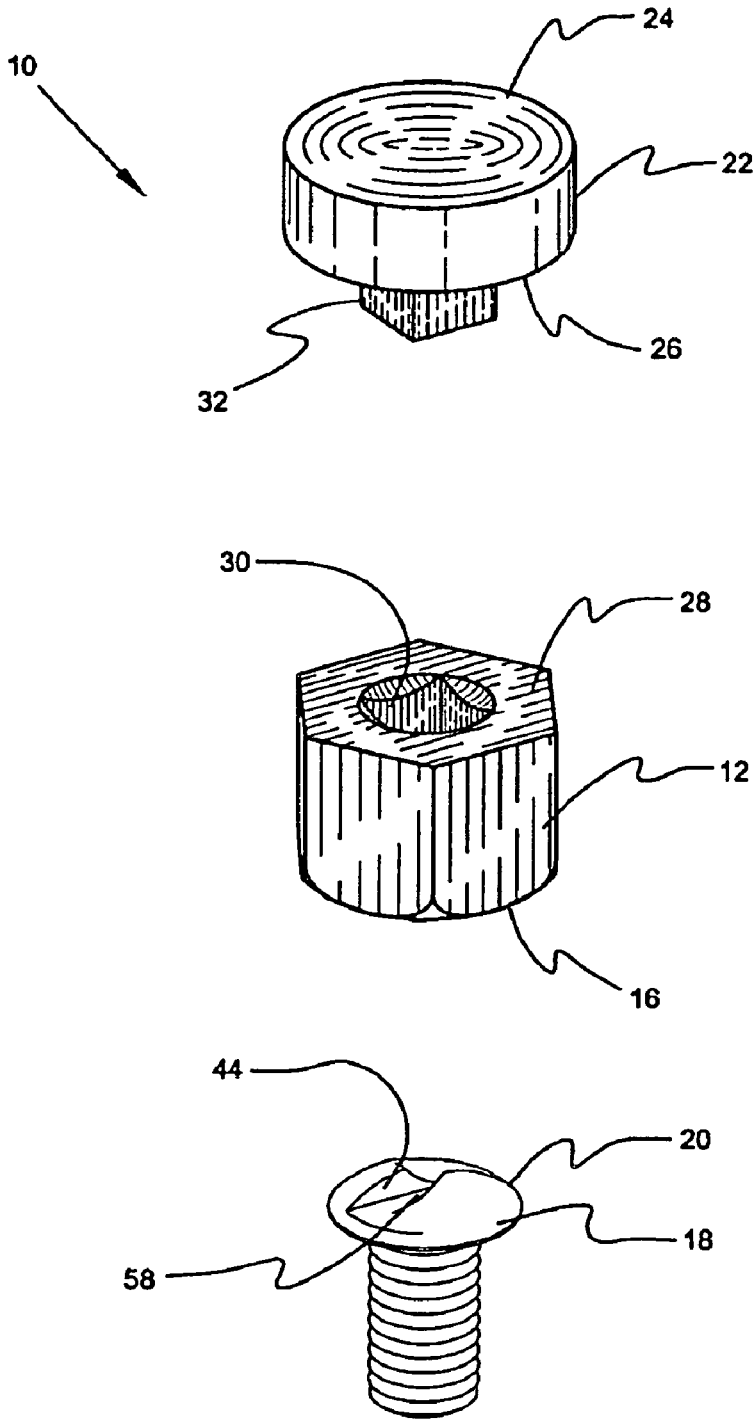
FIG. 2 is an exploded perspective view of a similar fastener impact driver device, in accordance with features of the present invention.
Figure 3:
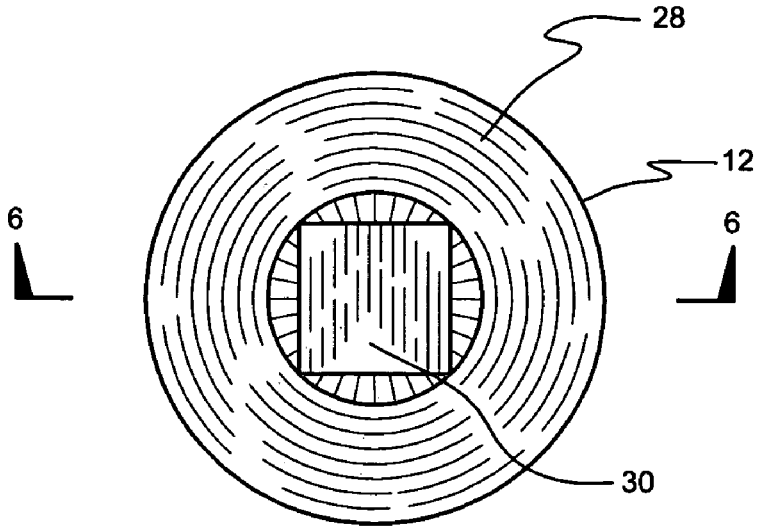
FIG. 3 is a top elevation view of a fastener engagement member of the device of FIG. 1 in accordance with features of the present invention.

Referring now to the drawings and in particular to FIGS. 1–9, a fastener impact driver device 10 in accordance with the present invention, is denoted by numeral 10. The device 10 includes a fastener engagement member 12 having a plurality of projections 14 disposed about a lower portion 16 that engages a corresponding peripheral portion 18 of a fastener 20. The device has many applications, but the preferred use is for extracting a one way fastener which is the fastener 20 depicted in FIG. 1. The device 10 further includes a positioning member 22 having an upper portion 24 that ultimately receives a force thereupon, said positioning member 22 having a lower portion 26 that engages a cooperating upper portion 28 of the fastener engagement member 12 whereby a force (a hammer strike) is imparted upon the upper portion 24 of the positioning member 22 to drive the projections 14 of the fastener engagement member 12 into the fastener 20 without damage to the fastener engagement member 12, whereupon the positioning member 22 is removed from the fastener engagement member 12 and a hand tool (not pictured) is removably secured to the fastener engagement member 12 to impart rotary force to the fastener engagement member 12 and the fastener 20 thereby removing the fastener 20 from or urging the fastener 20 into a workpiece (not pictured).

The fastener engagement member 12 and positioning member 22 are fabricated from a rigid, non-deformable material such as steel. The fastener engagement member 12 includes an axially disposed recess 30 in the upper portion 28 for removably receiving a protuberance 32 integrally joined to the positioning member 22. The recess 30 and protuberance 32 are cooperatively configured to maintain the axial orientation of the positioning member 22 relative to the fastener engagement member 12 irrespective of the quantity of force ultimately imparted upon the upper portion 24 of the positioning member 22. Although the recess 30 may include a cylindrical configuration thereby allowing rotation protuberance 32 within the recess 30, the preferred recess 30 configuration is substantially square as depicted in the top view of FIG. 2. The square configuration of the recess 30 promotes the transfer of rotary motion from the hand tool, which typically includes a substantially square configured protuberance, to the fastener engagement member 12 and ultimately to the fastener 20, when a user of the device 10 attempts to remove the fastener 20 from or urge the fastener 20 into a workpiece. Optionally, an exterior, circumferentially extending surface 13 of the fastener engagement member 12 is configured as a plurality of flat regions so as to enhance gripping of the member by a wrench.

Figure 4:
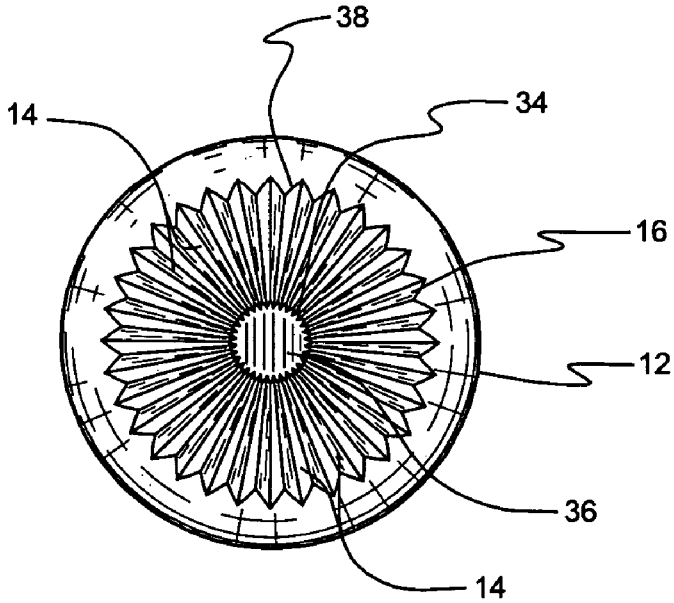
FIG. 4 is a bottom elevation view of the fastener engagement member of FIG. 3.
Figure 6:
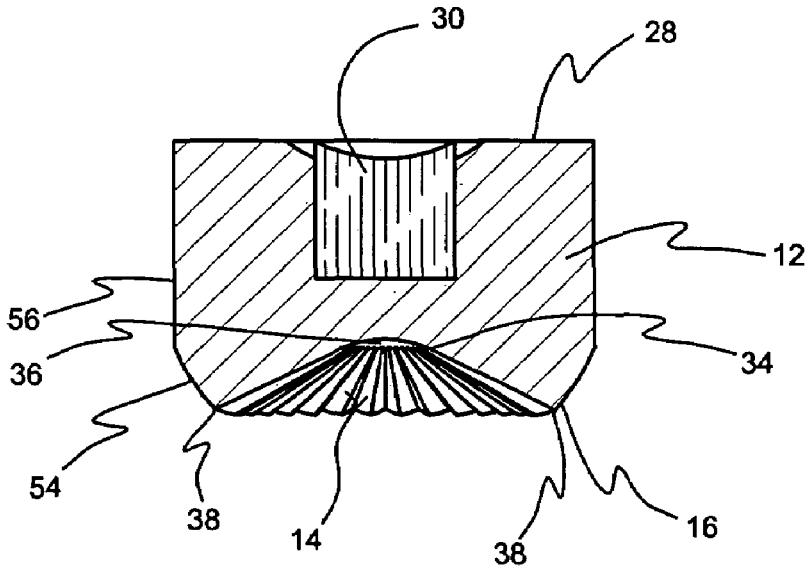
FIG. 6 is a sectional side view of the fastener engagement member of FIG. 3 taken along line 6—6 of FIG. 3.
Figure 7:
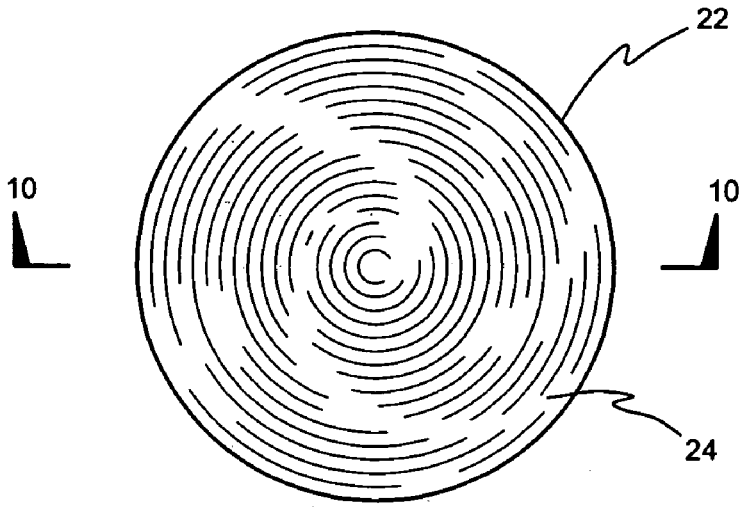
FIG. 7 is a top elevation view of a positioning member of the device of FIG. 1 in accordance with features of the present invention.
Figure 8:
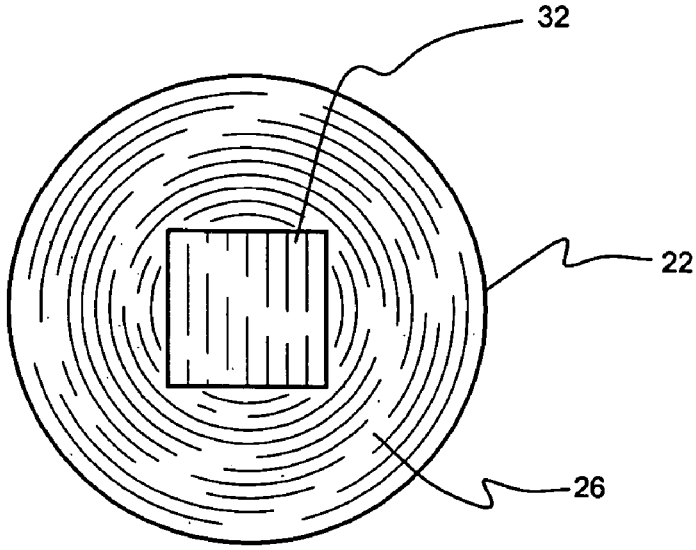
FIG. 8 is a bottom elevation view of the positioning member of FIG. 7.
Figure 9:
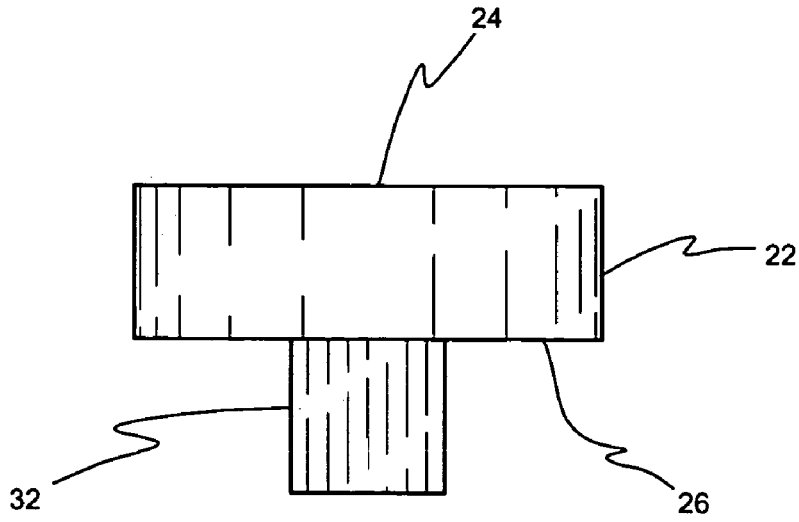
FIG. 9 is a side elevation view of the positioning member of FIG. 7.
Figure 10:
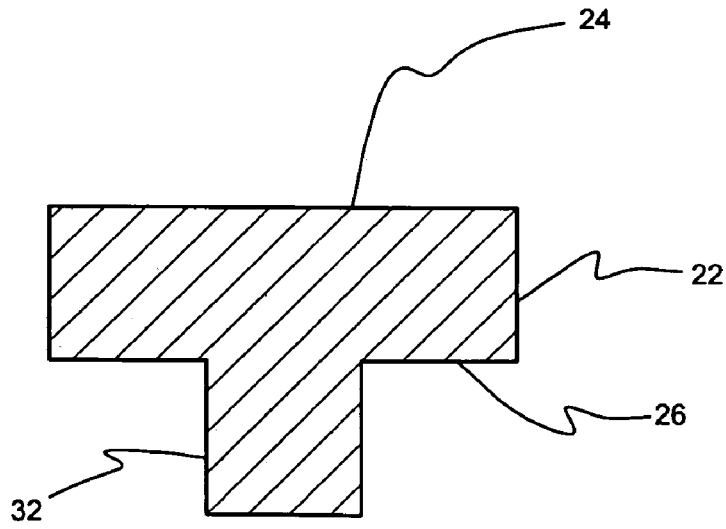
FIG. 10 is a sectional side view of the positioning member of FIG. 7 taken along line 10—10 of FIG. 7.
Figure 11:
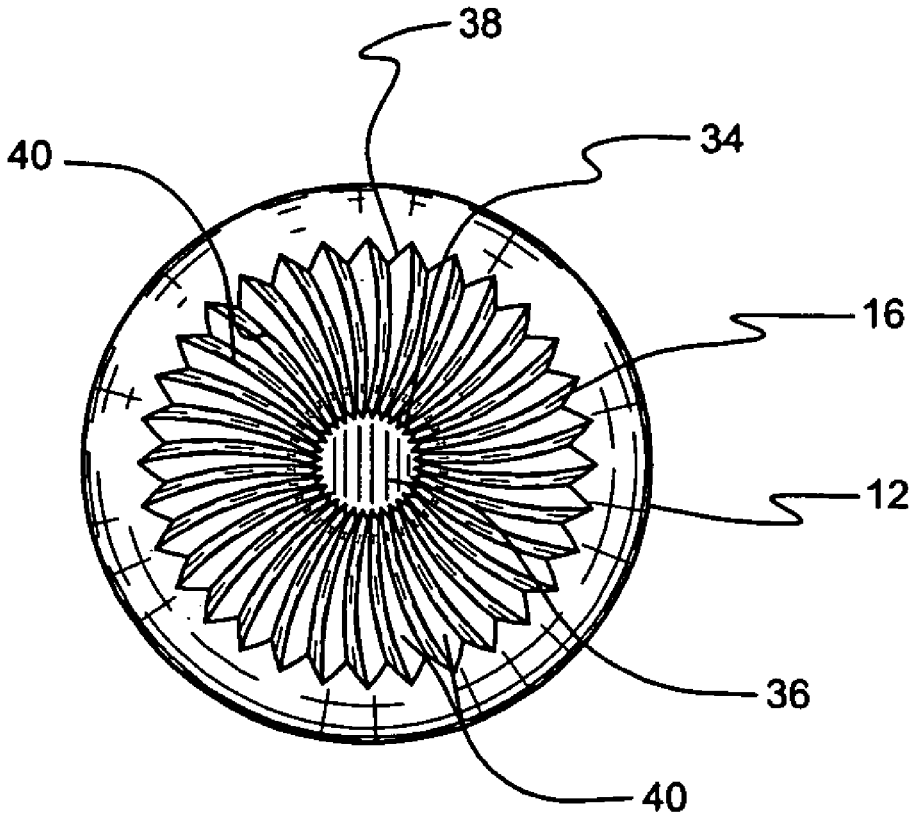
FIG. 11 is a bottom elevation view of the fastener engagement member as depicted in FIG. 4 but with arcuate projections configured to facilitate the removal of a fastener from a workpiece in accordance with features of the present invention.
Figure 12:
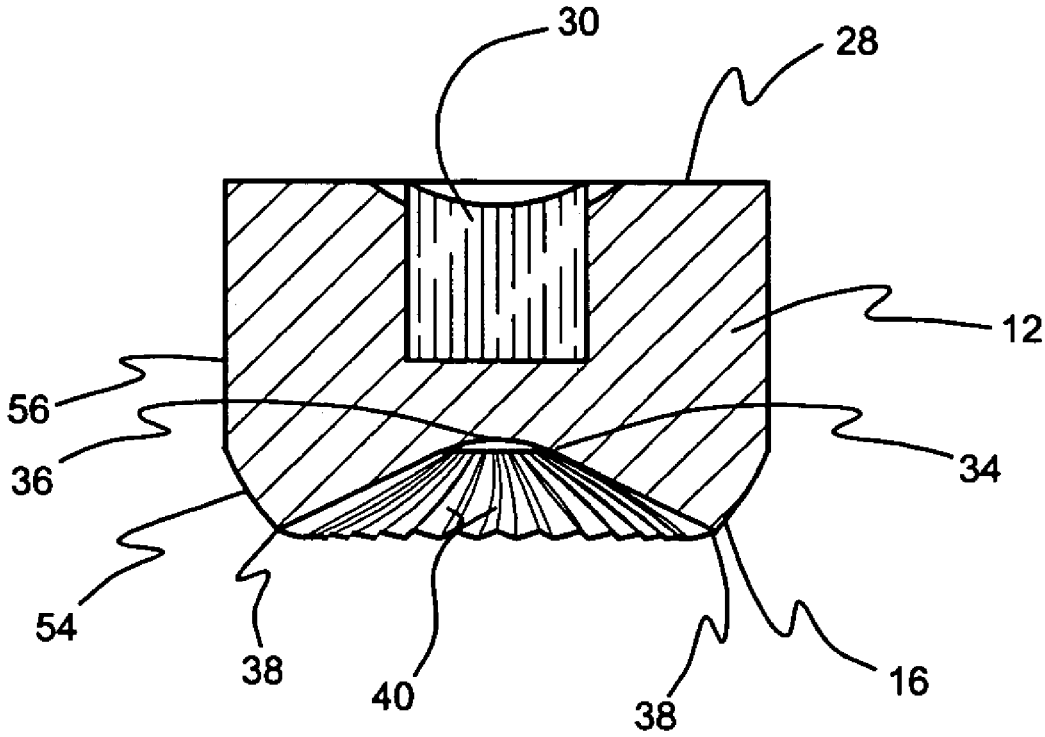
FIG. 12 is a sectional side elevation view of the fastener engagement member as depicted in FIG. 6 but with arcuate projections configured to facilitate the removal of a fastener from a workpiece in accordance with features of the present invention.
Figure 13:
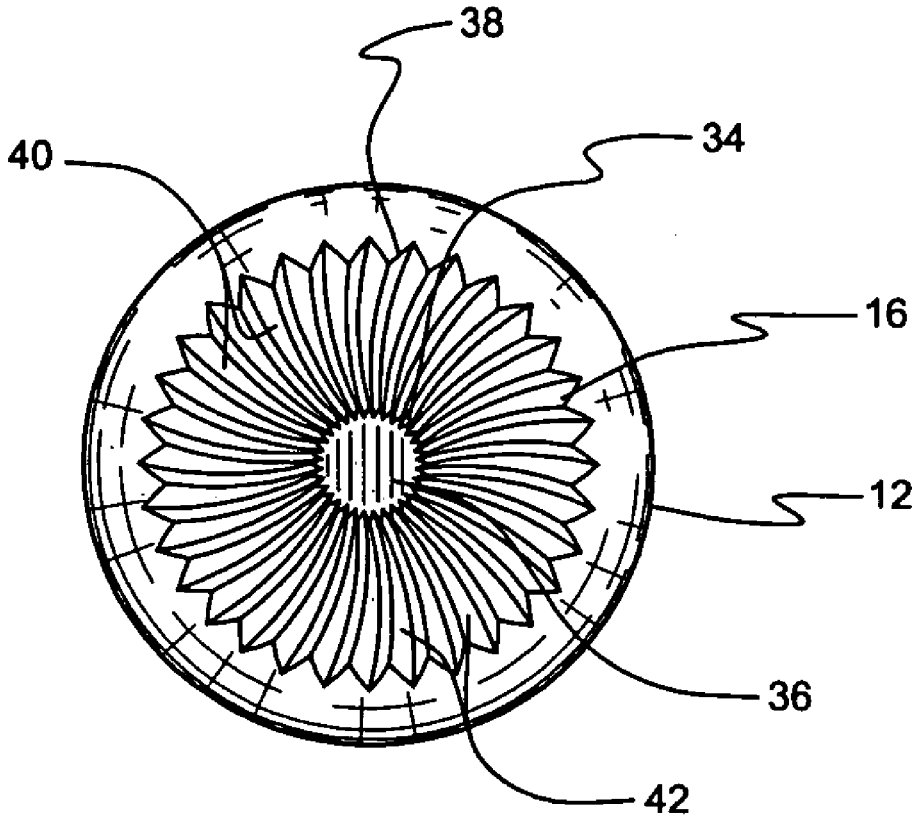
FIG. 13 is a bottom elevation view of the fastener engagement member as depicted in FIG. 4 but with arcuate projections configured to facilitate the insertion of a fastener into a workpiece in accordance with features of the present invention.
Figure 14:
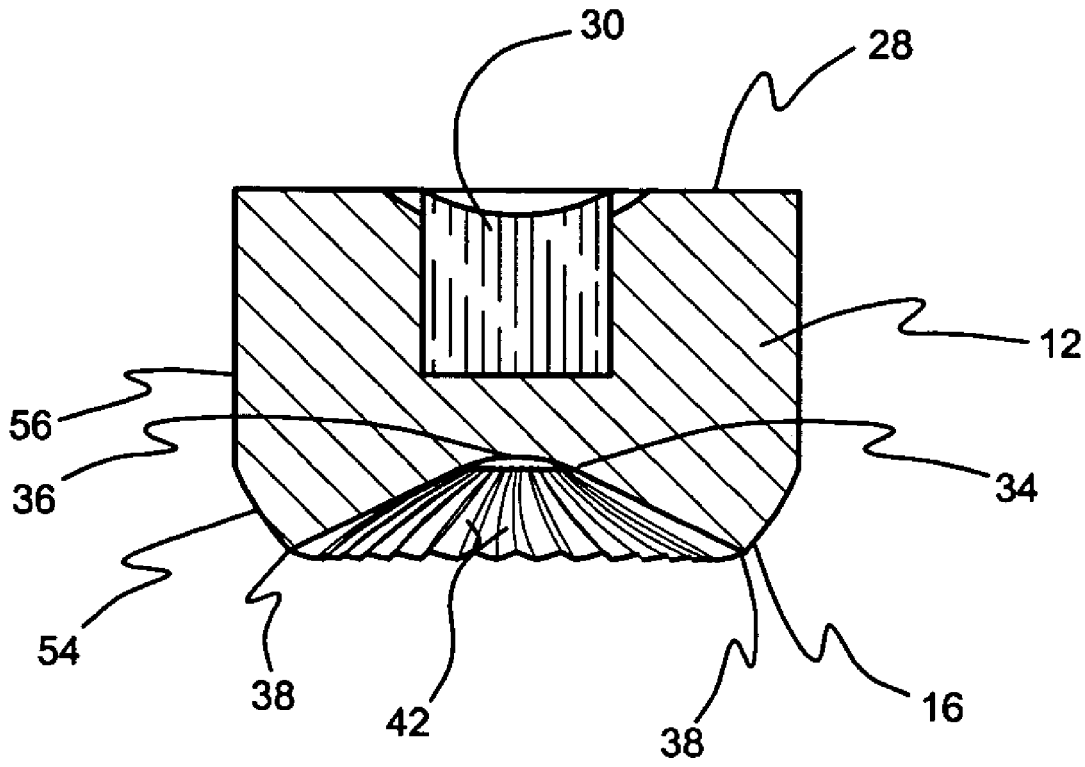
FIG. 14 is a sectional side elevation view of the fastener engagement member as depicted in FIG. 6 but with arcuate projections configured to facilitate the insertion of a fastener into a workpiece in accordance with features of the present invention.

Referring now to FIGS. 4 and 6, the projections 14 in the lower portion 16 of the fastener engagement member 12 are substantially radial, triangular configured "teeth" that extend from a relatively annular peripheral portion 34 of a concave recess 36 to a "saw tooth" configured bottom edge 38. An alternative configuration to the radially configured projections 14 of FIGS. 4 and 6, are the arcuately configured projections 40 and 42 of FIGS. 11,12 and 13,14, respectively. The arcuate configuration of the projections 40 of FIGS. 11 and 12, facilitate the removal of the fastener 20 from a workpiece. The arcuate configuration of the projections 42 of FIGS. 13 and 14, facilitate the insertion of the fastener 20 into the workpiece. The arcuate configurations 40 and 42 resist deformation as rotary motion is imparted upon a fastener head 44 portion of the fastener 20 by the projections 40 and 42 thereby providing an increase in rotary motion that can be transferred from the fastener engagement member 12 to the fastener 20 to prevent the projections from "breaking free" from the fastener head 44 and spinning upon the surface of the peripheral portion 18 of the fastener head 44.

The projections 14 have predetermined bottom configurations (as depicted in FIGS. 4–6 and 11–14) that promote the transfer of rotary motion from a hand tool to the fastener 20. Furthermore, the projections 14 have a predetermined side configurations as depicted in FIGS. 15–20 that promote the insertion of the projections 14 into the surface of the fastener head 44 as the fastener engagement member 12 is urged against the fastener head 44 by a hand tool engaging the fastener engagement member 12, or by a hammer forcibly striking a positioning member 22 disposed upon an upper portion 28 of the fastener engagement member 12.

Figure 15:
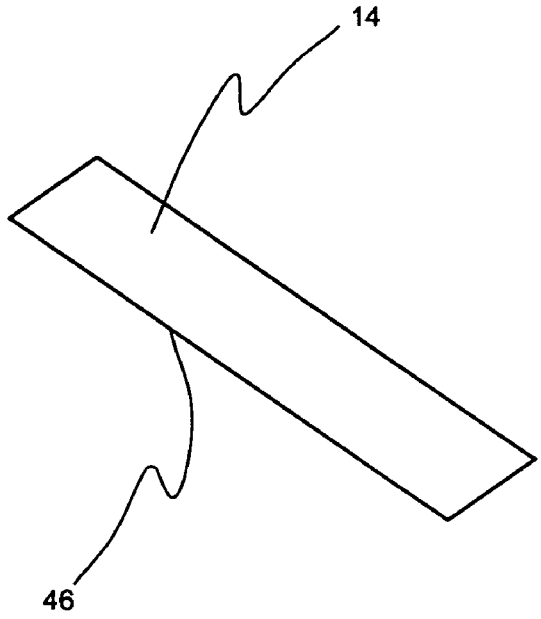
FIG. 15 is a side elevation view of the projections depicted in FIGS. 4 and 6, the projections having lineal cutting edges.

Referring to FIG. 15, the projections 14 include a substantially lineal cutting edge 46 that "cuts" or "saws" into the surface of the fastener head 44 when the fastener engagement member 12 receives a driving force thereupon. The configuration of the cutting edge 46 is generally smooth and continuous, however, the edge 46 may include serrations to promote the insertion of the edge 46 into the fastener head 44. The cutting edge 46 of FIGS. 15 and 16, may be used to rotate virtually any fastener head 44 except a head that is countersunk below the surface of a workpiece. The lineal cutting edge 46 of FIGS. 15 and 16 will grasp less of the fastener head 44 as the configuration of the head 44 becomes more round thereby reducing the amount of rotational force that may be applied to the fastener 20.

Figure 16:
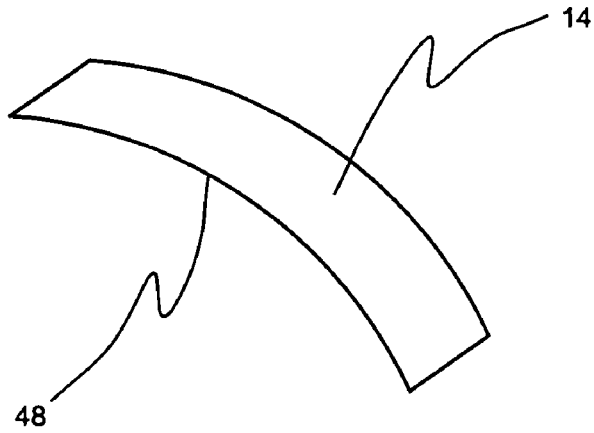
FIG. 16 is a side elevation view of the projections of FIG. 15, but with an arcuate cutting edge in accordance with features of the present invention.
Figure 17:
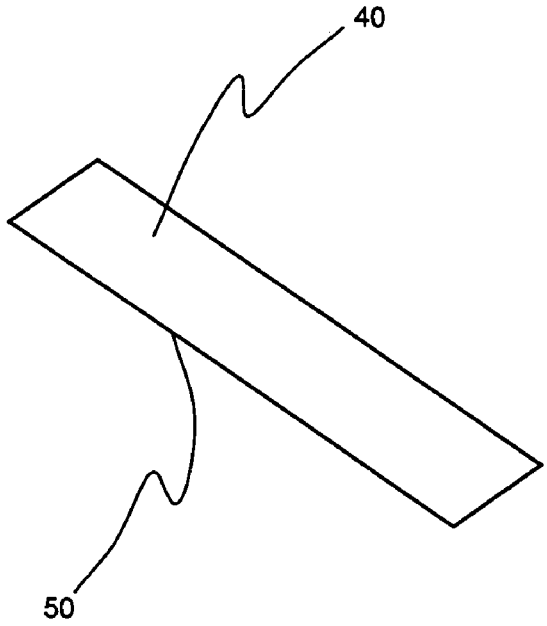
FIG. 17 is a side elevation view of the arcuate projections depicted in FIGS. 11 and 12, the projections having lineal cutting edges.
Figure 18:
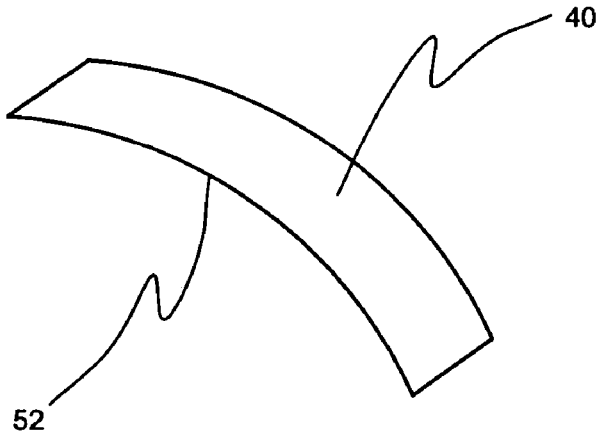
FIG. 18 is a side elevation view of the projections of FIG. 17, but with an arcuate cutting edge in accordance with features of the present invention.
Figure 19:
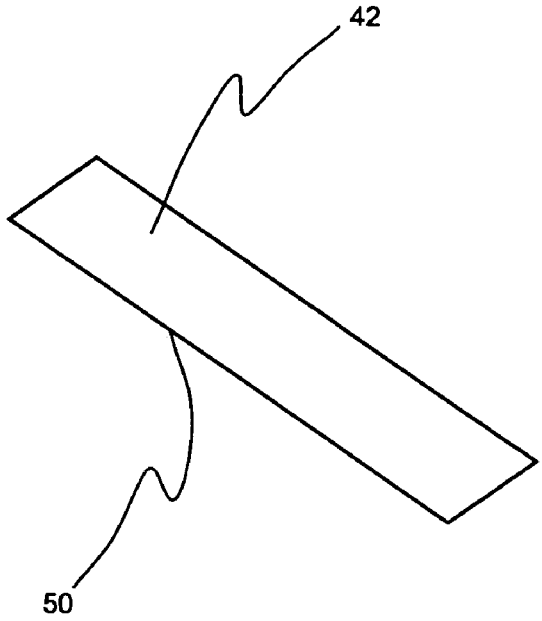
FIG. 19 is a side elevation view of the arcuate projections depicted in FIGS. 13 and 14, the projections having lineal cutting edges.
Figure 20:
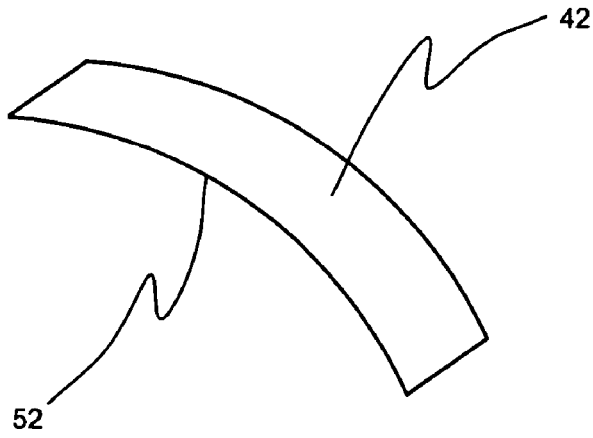
FIG. 20 is a side elevation view of the projections of FIG. 19, but with an arcuate cutting edge in accordance with features of the present invention.

Referring to FIG. 16, the projections 14 are depicted as being arcuate with an arcuate cutting edge 48 to facilitate increased engagement between the cutting edge 48 and a substantially round or oval fastener head 44. The projections 14 are radially disposed relative to the annular peripheral portion 34 of the concave recess 36 when taking a bottom view of the fastener engagement member 12. The configuration of the projections 14 of FIG. 16 promote the insertion of the edge 48 into the rounded fastener head 44.

Referring to FIGS. 17–20, side views of arcuate projections 40 and 42 are depicted as being lineal 50 or arcuate 52 to correspond to the configuration of the fastener head 44. The more oval the head configuration, the more arcuate the projection thereby providing sufficient engagement between the projections 40 and 42 and the fastener head 44 to promote the rotation of the fastener 20 into or out of a workpiece.

Figure 5:
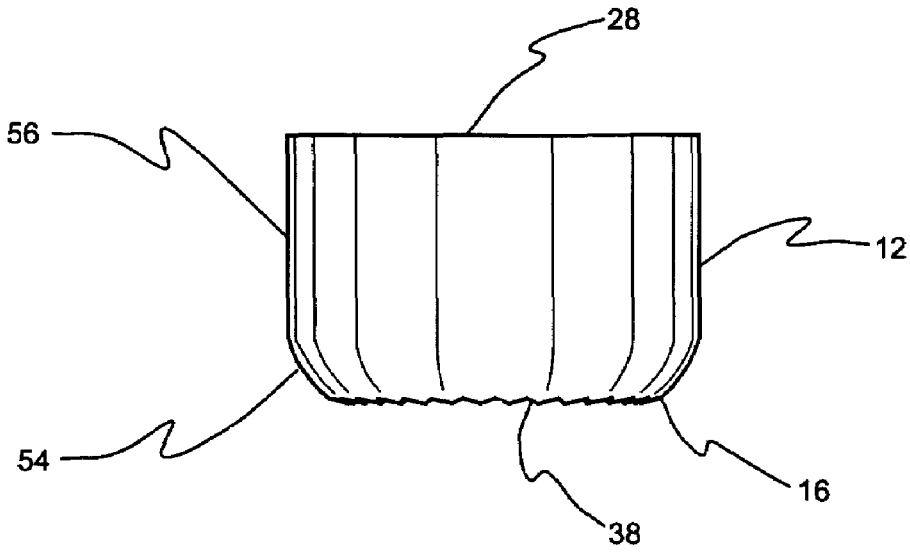
FIG. 5 is a side elevation view of the fastener engagement member of FIG. 3.

Referring now to FIG. 5, the fastener engagement member 12 includes a beveled portion 54 extending from the annular bottom edge 38 to an outer cylindrical side wall 56 of the fastener engagement member 12. The beveled portion 54 prevents the lower portion 16 of the fastener engagement member 12 from engaging a workpiece before the projections 14 of the engagement member 12 are inserted into the fastener 20 thereby promoting sufficient engagement between the projections 14 and the fastener head 44 such that the fastener engagement member 12 is capable of driving the fastener 20 into or removing the fastener 20 from a workpiece.

Furthermore, the beveled portion 54 promotes flexibility in the lower portion 16 of the fastener engagement member 12. As the arcuate cutting edges 48 of the projections 14 gouge into the peripheral portion 18 of the fastener head 44, the beveled portion 54 allows the annular bottom edge 38 to expand radially outward from the axis of the engagement member 12 thereby forcing the cutting edges 48 of the projections 14 to congruently engage corresponding portions of the fastener head 44 even with the initial configuration of the cutting edges 48 being relatively dissimilar to the configuration of the fastener head 44. The congruent engagement between the cutting edges 48 and the fastener head 44 increases the "grip" of the fastener engagement member 12 upon the fastener head 44 to promote the insertion or removal of the fastener 20. Should the configurations of the cutting edges 46 and the fastener head 44 be substantially dissimilar, the annular bottom edge 38 will not expand sufficiently to promote congruent engagement between the cutting edges 48 and the fastener head 44. The expanding bottom edge 38 will also promote congruent engagement between the arcuate cutting edges 52 of the arcuately configured projections 40 and 42. The lineal cutting edges 46 and 50 of the projections 14, 40 and 42 will limit expansion of the annular bottom edge 38 thus reducing engagement between the projections and a corresponding fastener head 44 and proportionately reducing the amount of rotary motion that may be transferred from the fastener engagement member 12 and the fastener 20.

The recess 30 in the lower portion 16 of the fastener engagement member 12 is configured to receive a central portion 58 (see FIG. 2) of the fastener head 44 of the fastener 20 to promote the unobstructed engagement between the projections 14 and the peripheral portion 18 of the fastener head 44. The recess 30 must be dimensioned to receive the fastener head 44 irrespective of the type of fastener 20 (one-way, arcuate, flat or damaged), and to allow a projection 14 length that promotes maximum contact between the cutting edges 46, 48 and the peripheral portion 18 of the fastener head 44.

Figure 21:
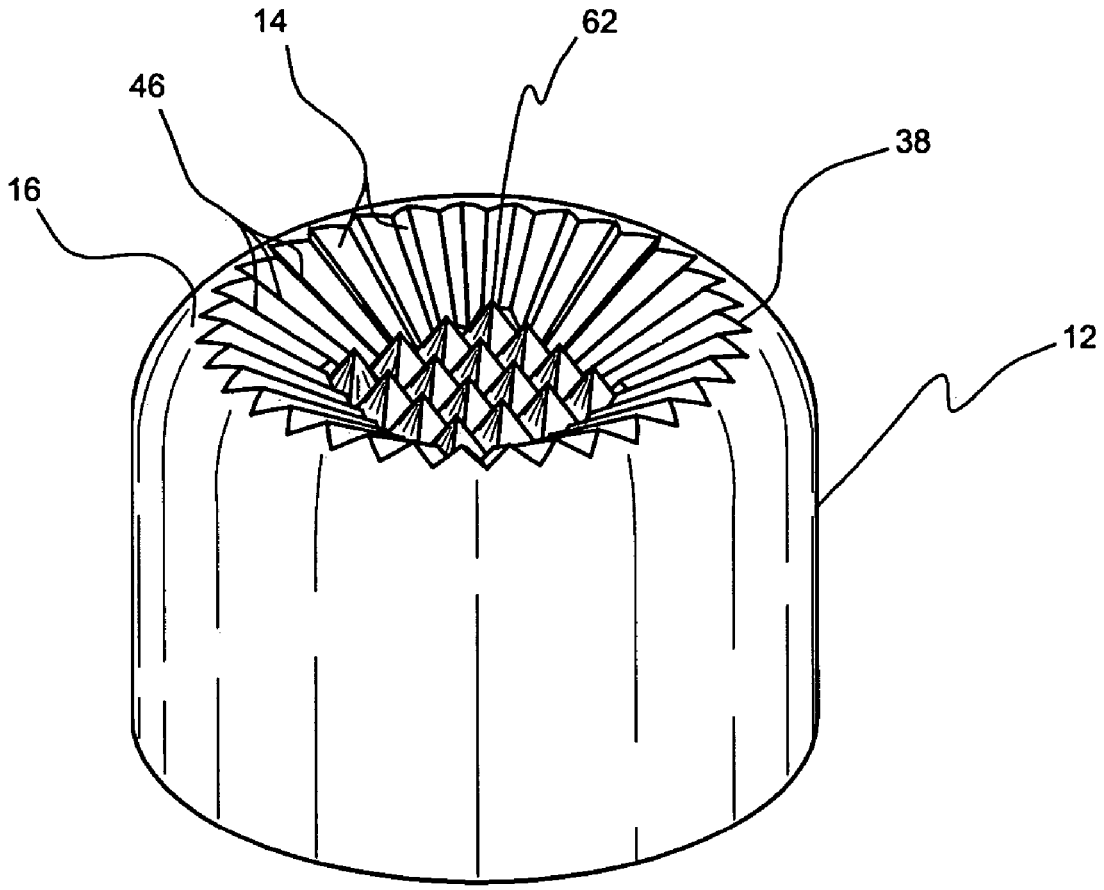
FIG. 21 is a bottom perspective view of the fastener engagement member depicted in FIG. 4, but with an alternative design for a recess in a lower portion in accordance with features of the present invention.
Figure 22:
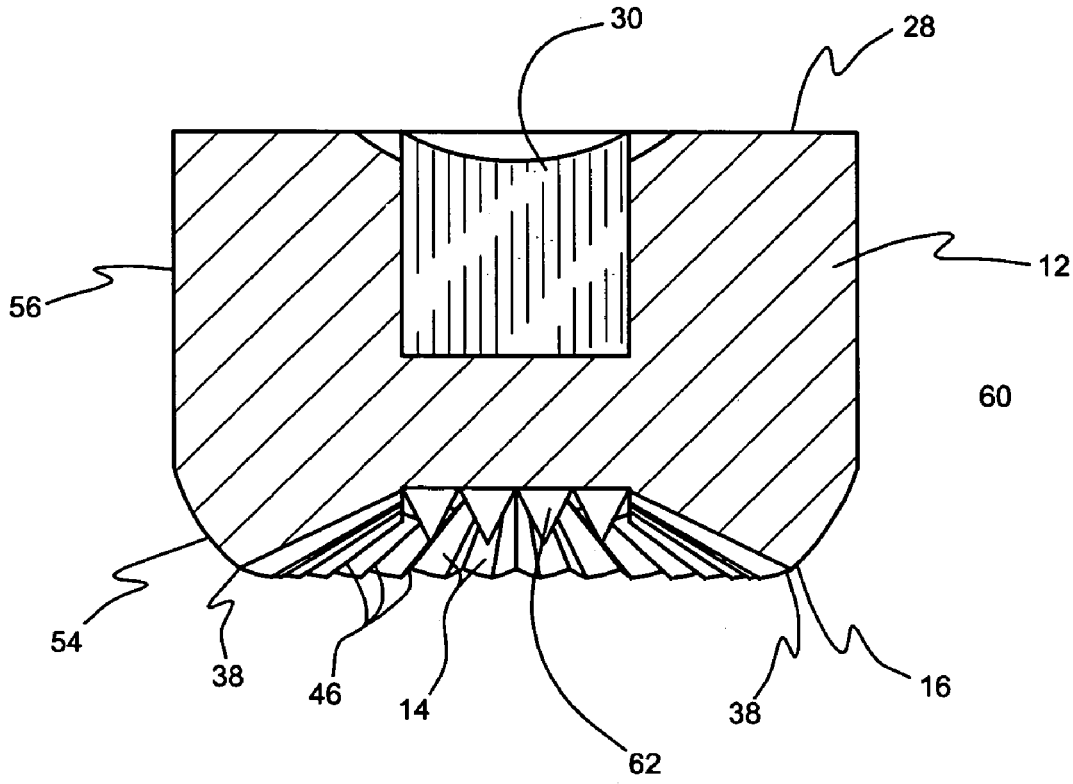
FIG. 22 is a sectional side view of the fastener engagement member depicted in FIG. 21.
Figure 23:
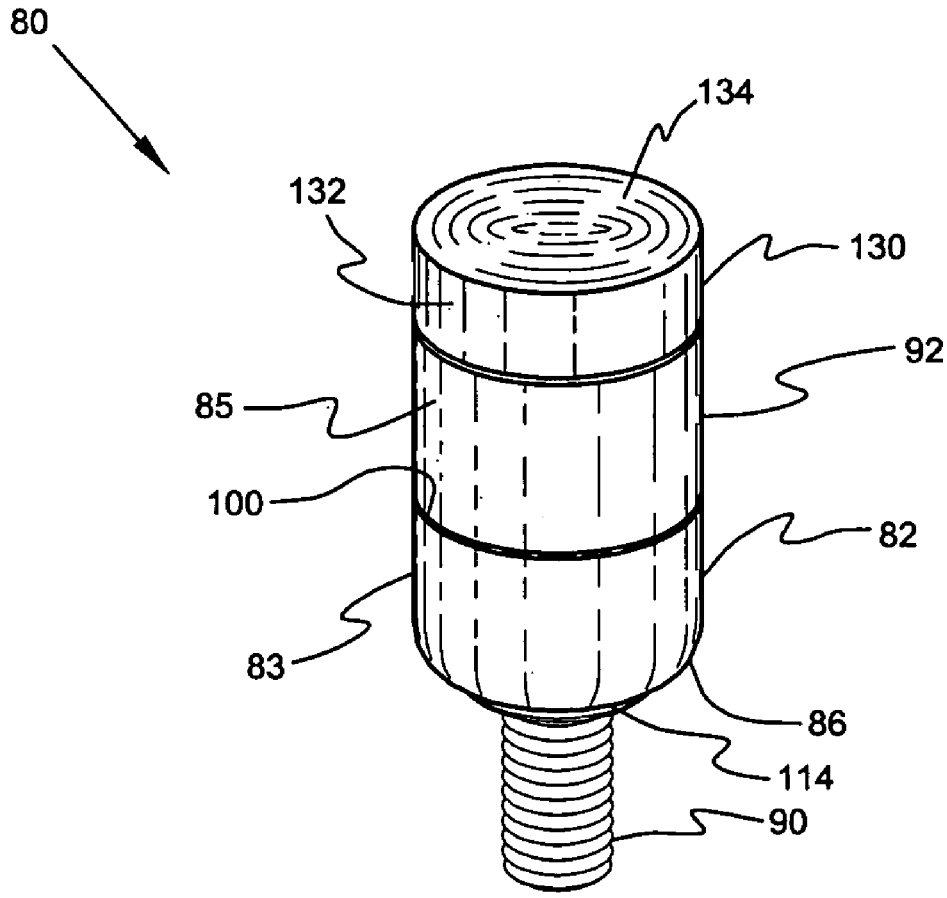
FIG. 23 is a perspective view of an alternative fastener impact driver device in accordance with features of the present invention.
Figure 24:
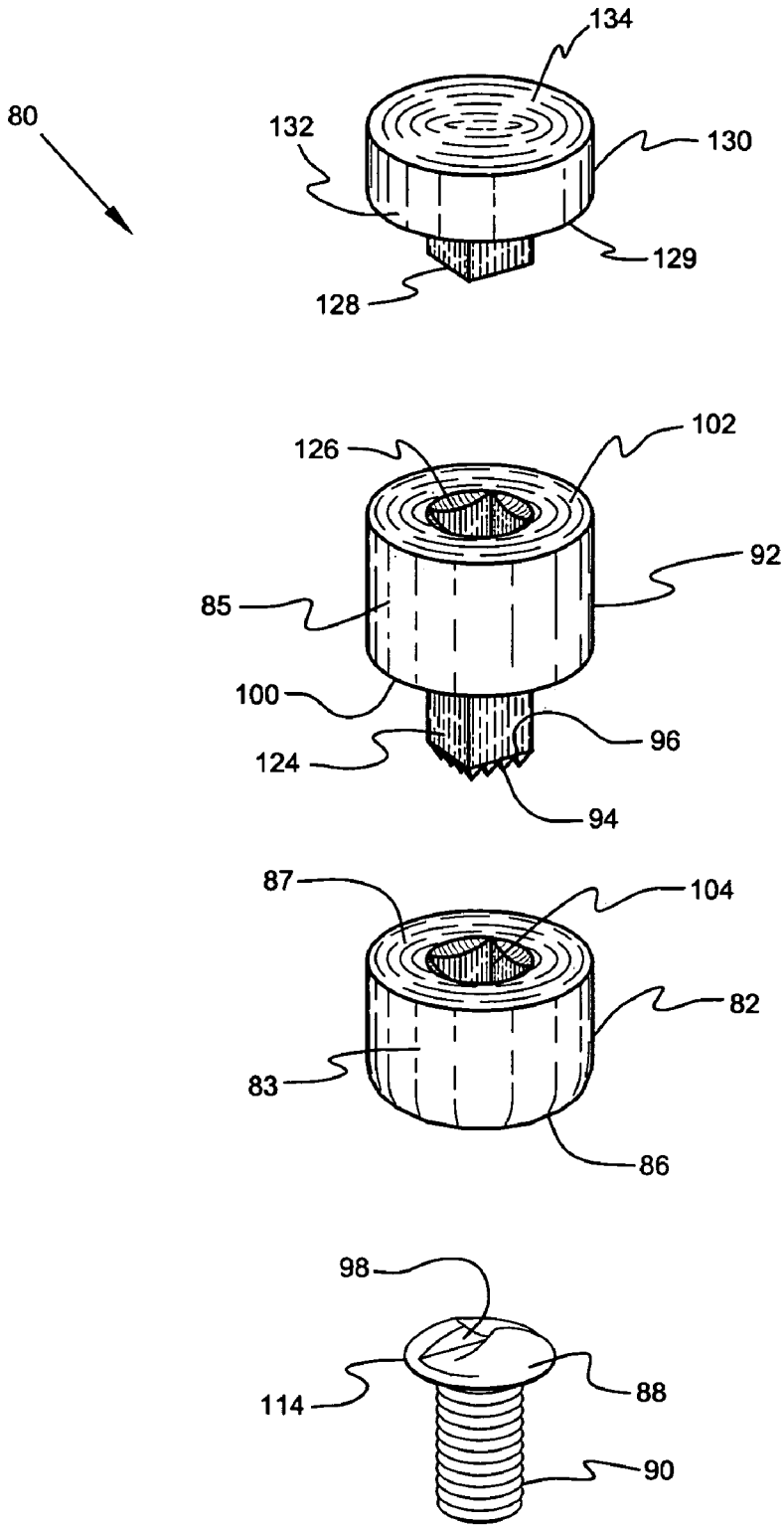
FIG. 24 is an exploded perspective view of the device of FIG. 23.
Figure 25:
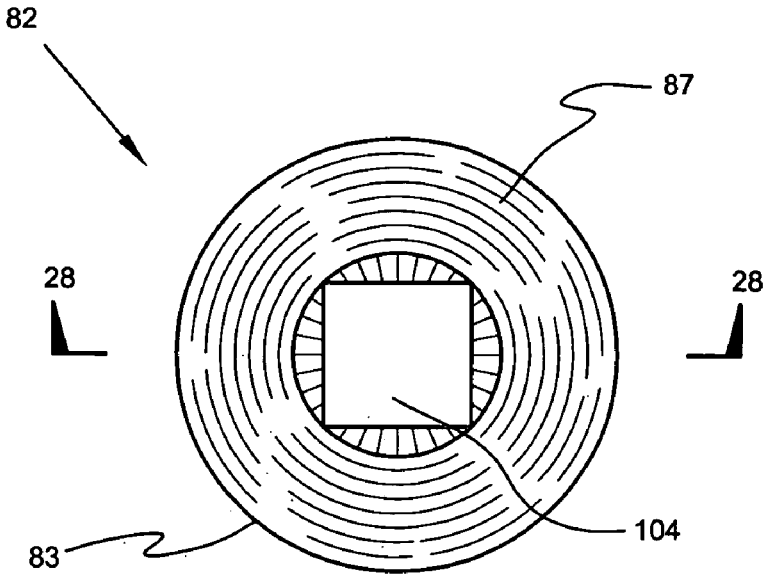
FIG. 25 is a top elevation view of a first fastener engagement member of the device of FIG. 23 in accordance with features of the present invention.
Figure 26:
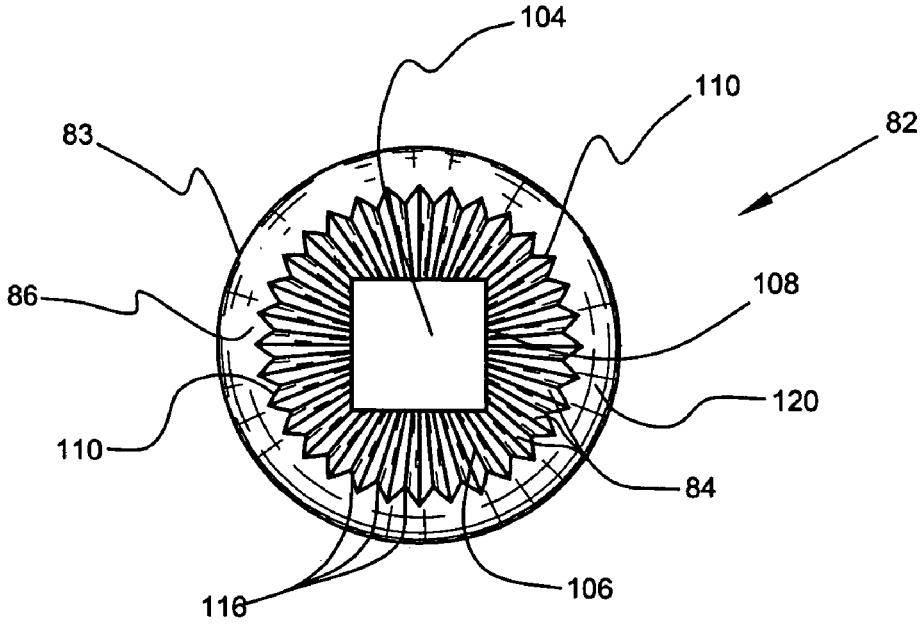
FIG. 26 is a bottom elevation view of the first fastener engagement member of FIG. 25.
Figure 27:
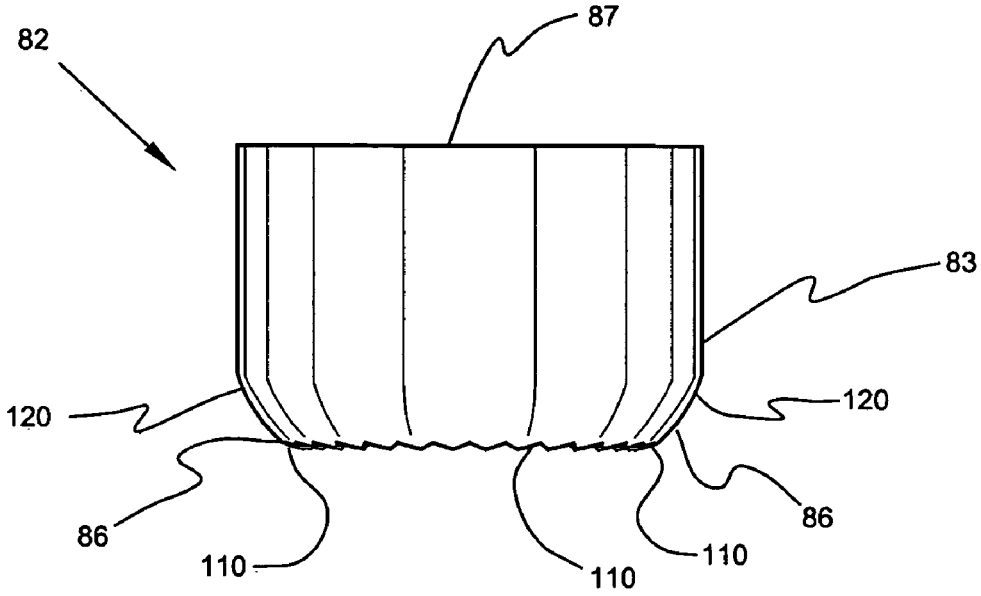
FIG. 27 is a side elevation view of the first fastener engagement member of FIG. 25.
Figure 28:
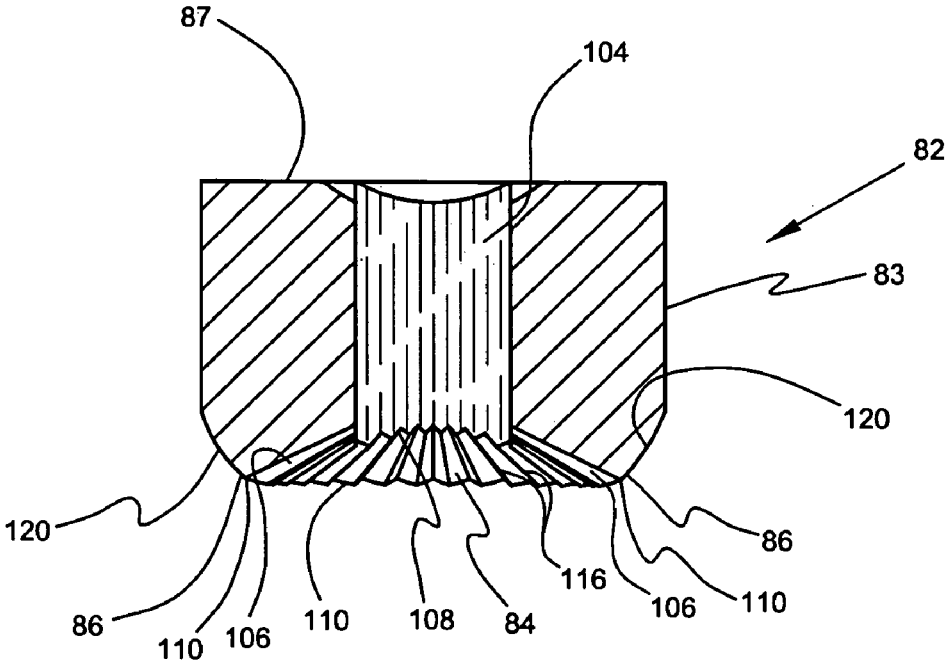
FIG. 28 is a sectional side view of the first fastener engagement member of FIG. 25 taken along line 28—28 of FIG. 25.
Figure 29:
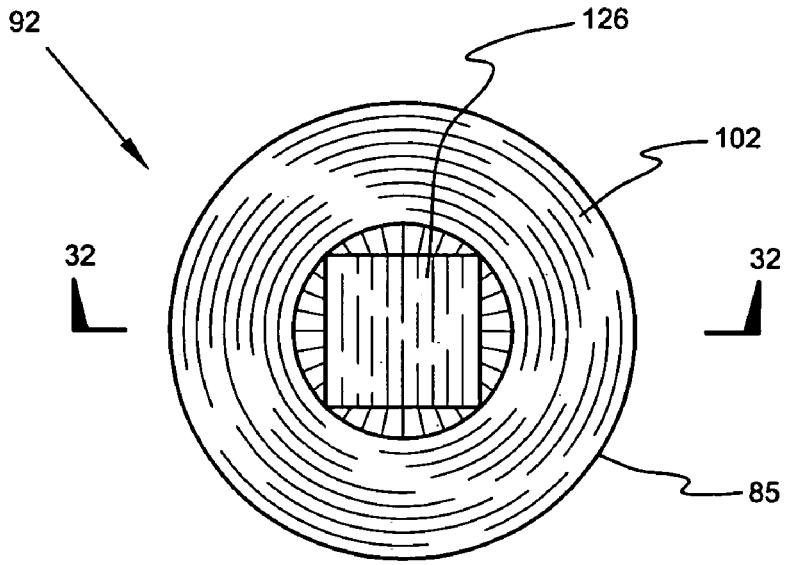
FIG. 29 is a top elevation view of a second fastener engagement member of the device of FIG. 23 in accordance with features of the present invention.
Figure 30:
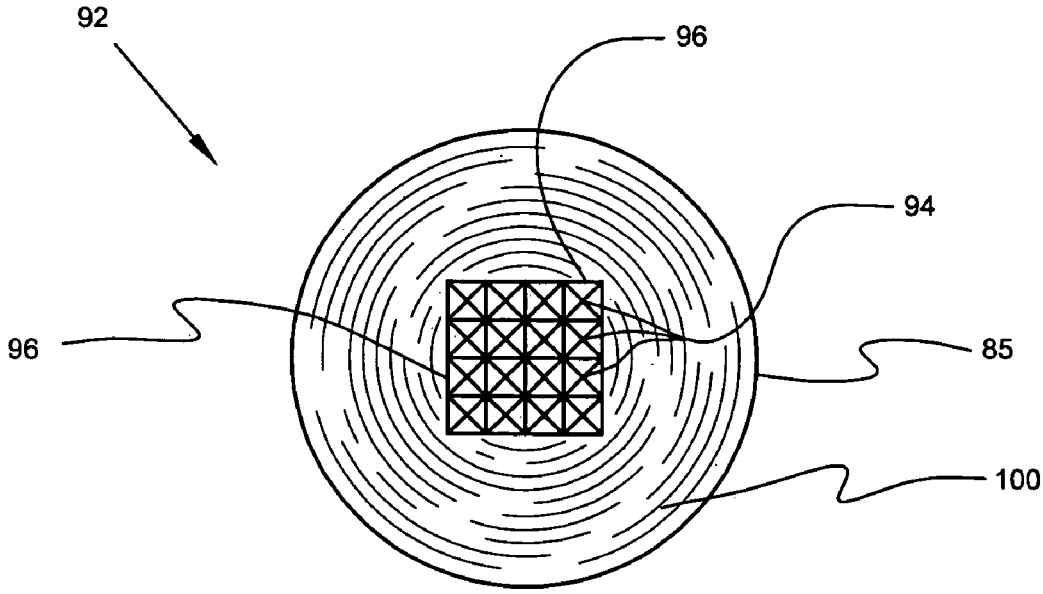
FIG. 30 is a bottom elevation view of the second fastener engagement member of FIG. 29.
Figure 31:
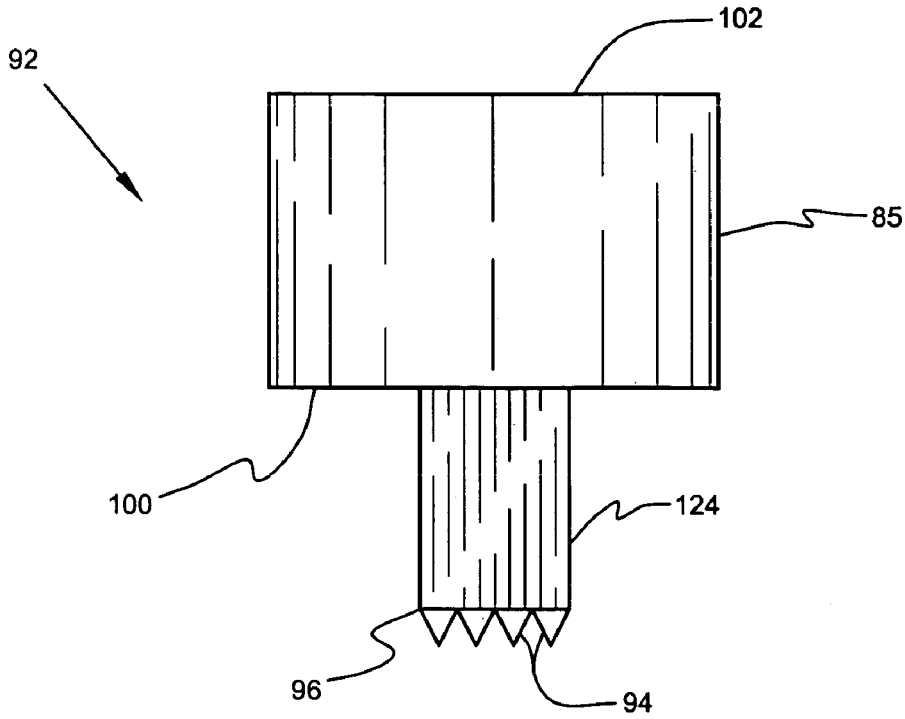
FIG. 31 is a side elevation view of the second fastener engagement member of FIG. 29.
Figure 32:
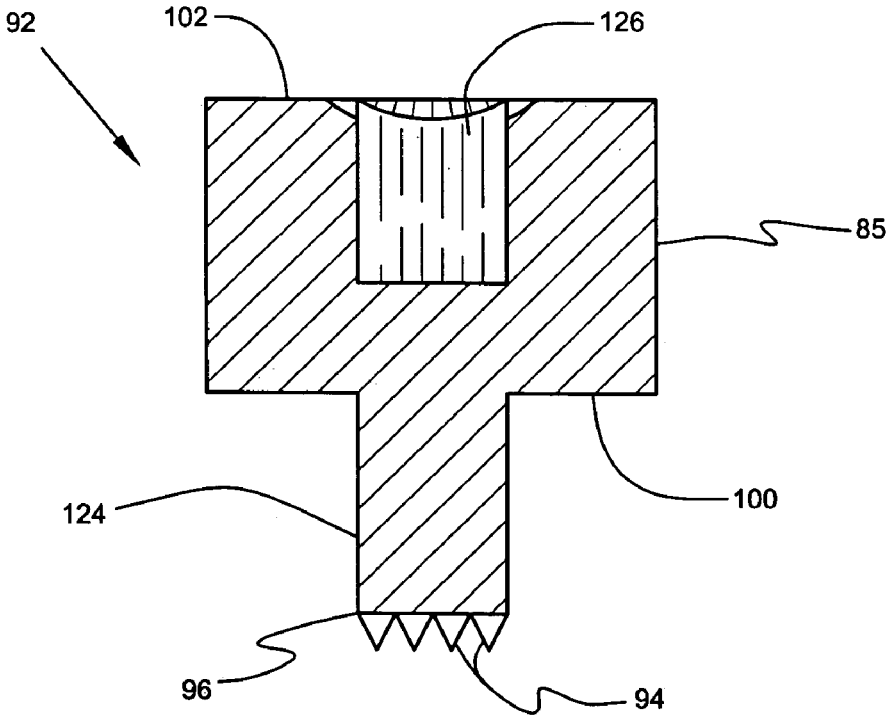
FIG. 32 is a sectional side view of the second fastener engagement member of FIG. 29 taken along line 32—32 of FIG. 29.
Figure 33:
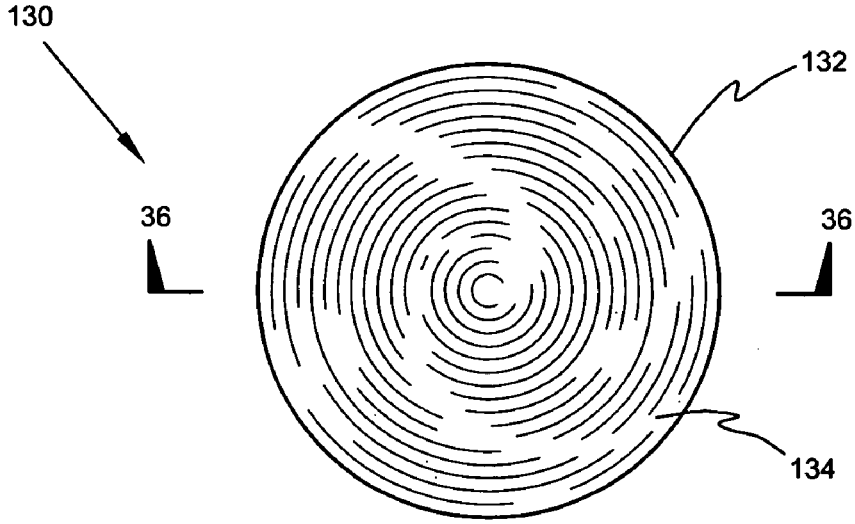
FIG. 33 is top elevation view of a positioning member of the device of FIG. 23 in accordance with features of the present invention.
Figure 34:
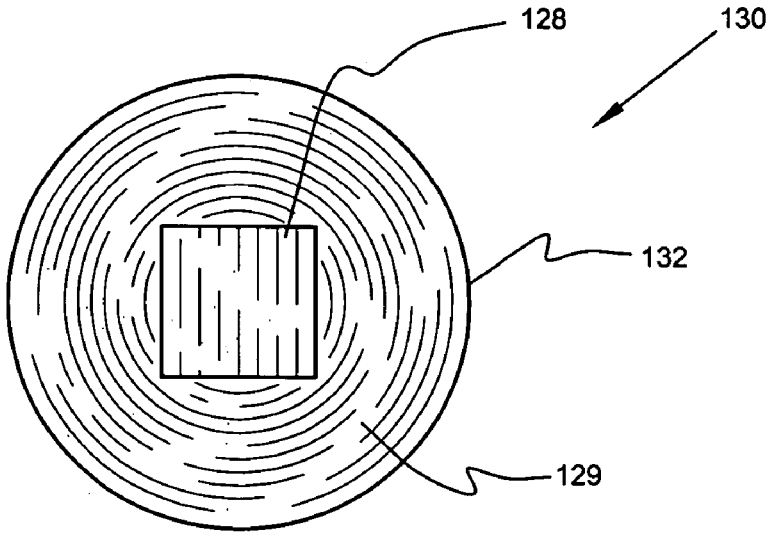
FIG. 34 is a bottom elevation view of the positioning member of FIG. 33.
Figure 35:
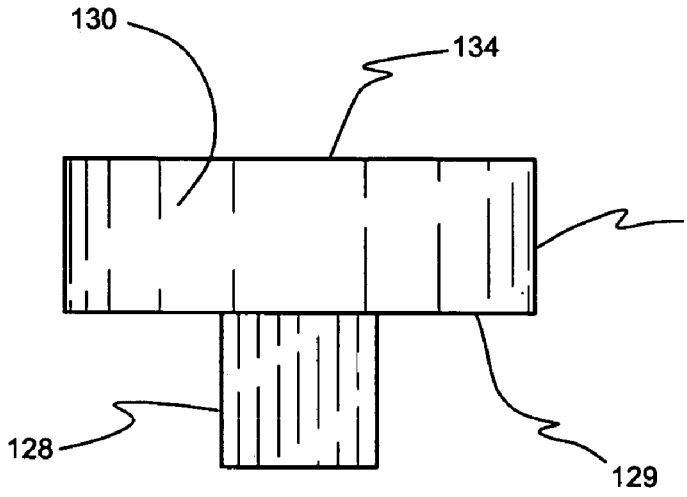
FIG. 35 is a side elevation view of the positioning member of FIG. 33.
Figure 36:
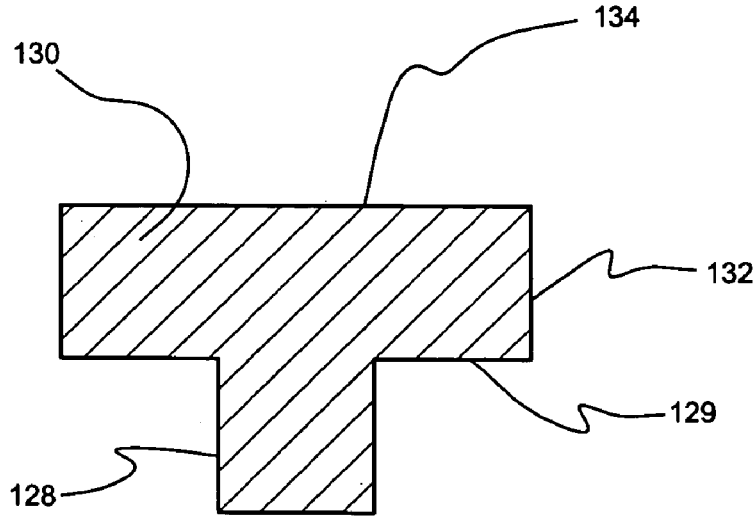
FIG. 36 is a sectional side view of the positioning member of FIG. 33 taken along line 36—36 of FIG. 33.

Referring now to FIGS. 21 and 22, an alternative design for the recess 30 in the lower portion 16 of the fastener engagement member 12 is depicted. In place of the recess 30, the engagement member 12 includes a planar surface 60 having a plurality of pyramid configured points or projections 62 extending from the surface 60 to ultimately engage and grasp the central portion 58 of the fastener head 44. The alternative design provides increased gripping capability for the fastener engagement member 12 when used to impart rotational force to insert or extract a fastener 20 with a worn head 44 or with a head 44 configuration that limits engagement between the projections 14 and the peripheral portion 18 of the fastener head 44. The pyramid projections 62 and the cutting edges 46 or 48 of the projections 14 engage some but not all portions of the fastener head 44, but the combined "bite" of the edges 46 and pyramid projections 62 promote a transfer of rotary force sufficient to insert or remove a fastener 20 into or from a workpiece.

In operation, a fastener engagement member 12 is selected to extract or insert a fastener 20 into a workpiece. Although the application of the fastener engagement member 12 is extensive, the preferred use of the member 12 is to extract a one way fastener 20 from a workpiece. The fastener engagement member 12 is positioned upon the fastener 20 such that the projections 14 engage a peripheral portion 18 of the fastener head 44. A hammer or similar blunt instrument is struck upon a top wall or upper portion 28 to force the projections 14 into the fastener head 44. A hand tool such as a ratchet with a protuberance extending therefrom is inserted into a recess 30 in the upper portion 28 thereby imparting rotary motion upon the fastener engagement 12 and ultimately upon the fastener head 44 via the projections 14 to extract the fastener 20 from a workpiece. To prevent the fastener engagement member 12 from being deformed by hammer strikes, a positioning member 22 is disposed upon the fastener engagement member 12. The axial orientation of the positioning member 22 relative to the fastener engagement member 12 is maintained irrespective of the quantity of force ultimately imparted upon the upper portion of the positioning member 22 by a protuberance 32 extending from a lower portion 26 of the positioning member 22 into the recess 30 of the fastener engagement member 12. Upon driving the projections 14 into the fastener head 44, the positioning member 22 is removed and the hand tool substituted therefor to rotate the fastener engagement member 12 and extract the fastener 20.

Figure 37:
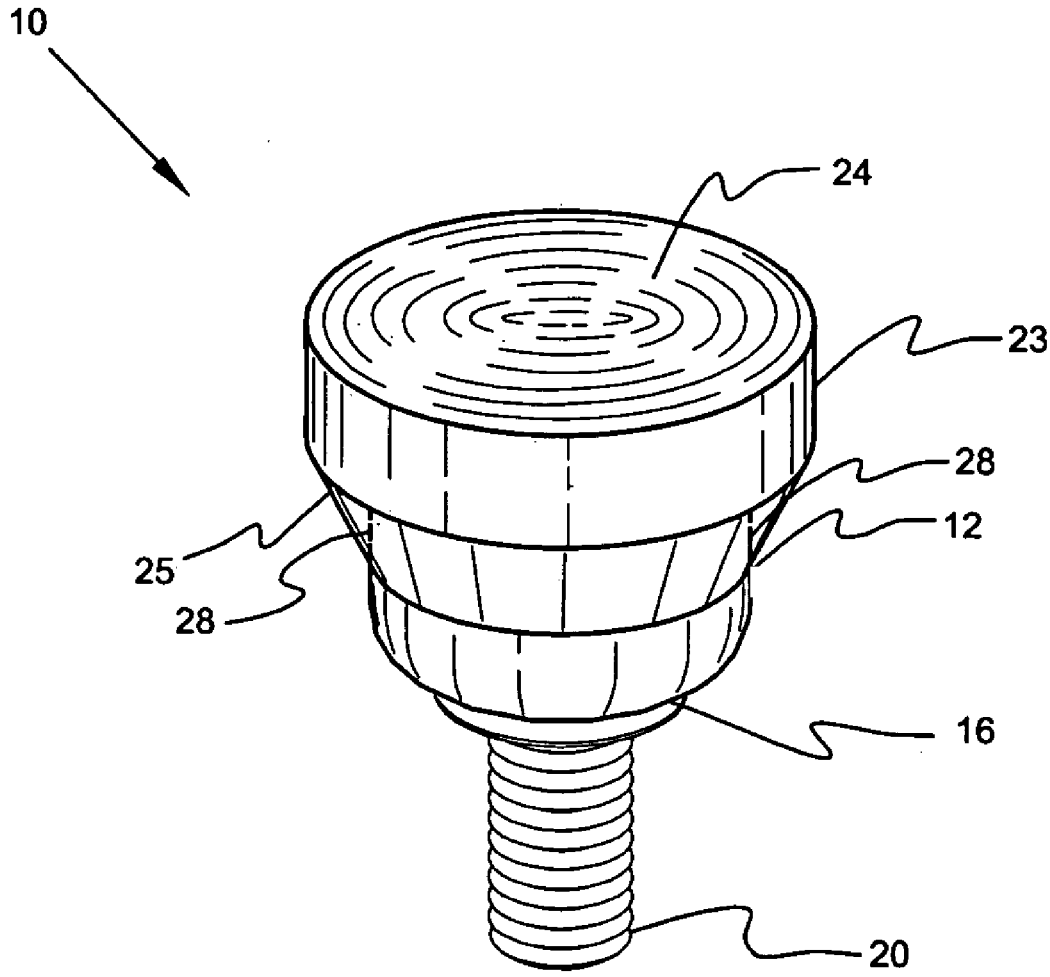
FIG. 37 is a perspective view of an alternative positioning member which includes an extension to protect an operators fingers. The alternative positioning member may be utilized with either version of the fastener impact driver device.
Figure 38:
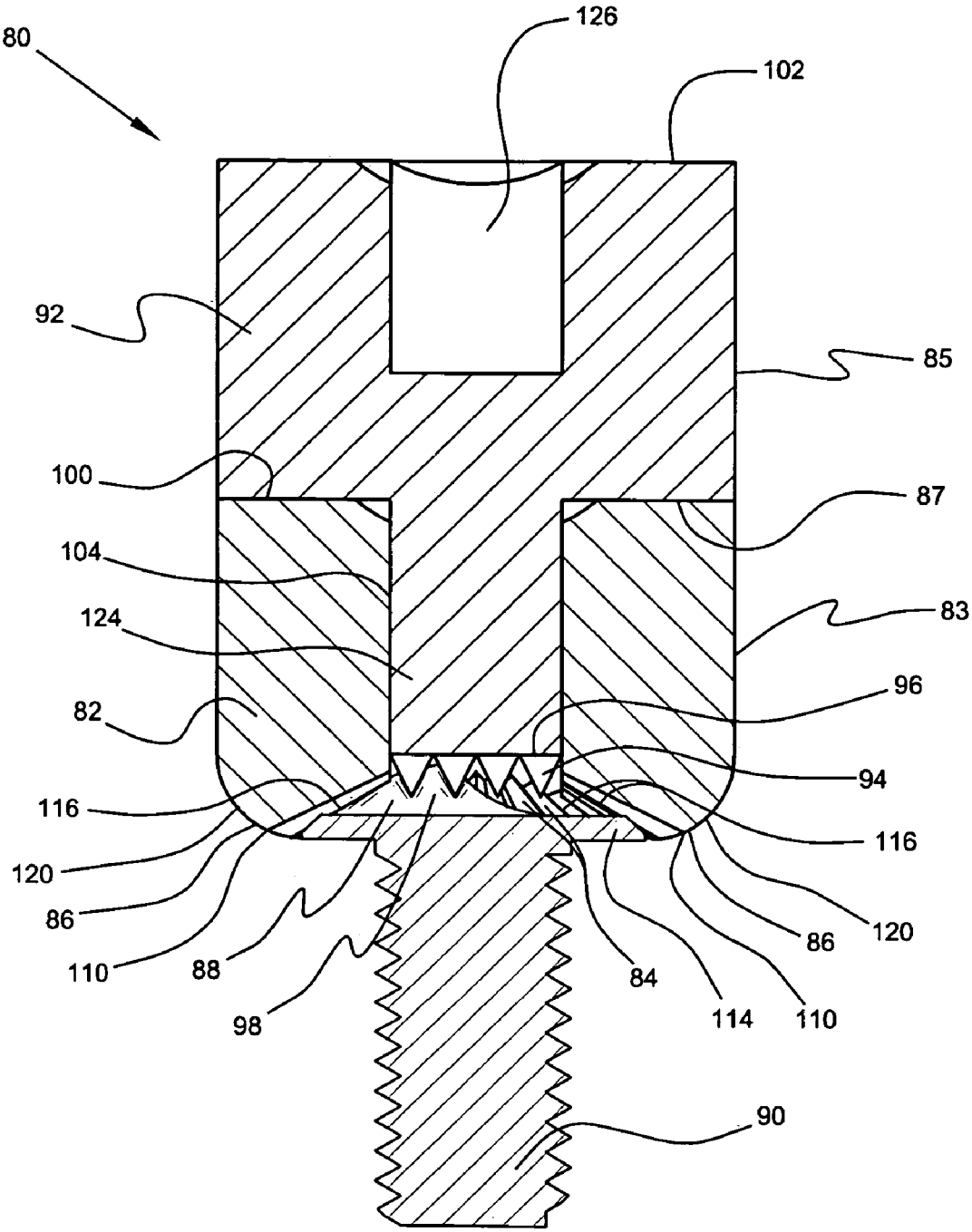
FIG. 38 is a sectional side view (without the positioning member) of the alternative impact driver device of FIG. 23 engaging the fastener head.

Should an operator become careless when using the present invention, one or more fingers could be "pinched" between the positioning member 22 and the fastener engagement member 12. To prevent finger injury, a modification of the positioning member 22 in accordance with the present invention is depicted in FIG. 37. The modified positioning member 23 includes a tapered extension 25 with a cylindrical recess that snugly receives the upper portion 28 of the fastener engagement member 12 such that the operator's fingers are prevented from engaging the upper portion 28 of the fastener engagement member 12 when the operator strikes the upper portion 24 of the modified positioning member 23 with a hammer.

Some fasteners 20 selected for removal have corroded, deformed or otherwise damaged heads 44 which require a fastener engagement member 12 with modifications that provide added gripping capability to extract the fastener 20. The modifications include changing the configuration of the projections 14 to include an arcuate configuration 48, 50 and 52. Further modifications include the addition of pyramid configured projections 62 to a planar surface 60 in a central portion of the fastener engagement member 12. The pyramid projections 62 grasp a central portion 58 of the fastener head 44 thereby cooperating with the arcuate projections to increase the grip of the fastener engagement member 12 upon the fastener head 44 to ultimately increase the quantity of rotary motion imparted upon the fastener 20 to remove the fastener 20 from a workpiece. Unfortunately, some fasteners 20 are damaged so severely that all the aforementioned options prove ineffective. To rotate these damaged fasteners 20, further modifications are required.

Referring now to FIGS. 23–36, and 38, an alternative fastener impact driver device in accordance with the present invention, is denoted by numeral 80. The alternative device 80 includes a first fastener engagement member 82 having a cylindrical side wall 83 and a plurality of first projections 84 disposed upon a concave, relatively annular configured, when taking a bottom view, bottom wall 86 that engages a corresponding peripheral portion 88 of a fastener 90. The first fastener engagement member 82 has an annular top planar wall 87, when taking a top view, that ultimately receives a force thereupon that forces the first projections 84 into the corresponding peripheral portion 88 of the fastener 90. The alternative device 80 further includes a second fastener engagement member 92 having a cylindrical side wall 85 and a plurality of second projections 94 disposed upon a bottom portion 96 that engages a corresponding central portion 98 of the fastener 90. The second fastener member 92 has an annular bottom wall 100 that engages the top wall 87 of the first fastener engagement member 82. The second fastener member 92 has an annular top planar wall 102, when taking a top view, that ultimately receives a force thereupon that forces the first and second projections 84 and 94 into corresponding peripheral and central portions 88 and 98 of the fastener 90. The bottom portion 96 of the second fastener engagement member 92 extends through an aperture 104 in the first fastener engagement member 82 to ultimately engage the central portion 98 of the fastener 90.

Referring to FIGS. 23–28, the first fastener engagement member 82 is fabricated from a rigid, non-deformable material such as steel. The aperture 104 is axially disposed and extends through the first fastener engagement member 82. The aperture 104 has a square configuration, when taking a top view of the member 82, to promote the transfer of rotary motion from the second fastener engagement member 92 to the first fastener engagement member 82. The first projections 84 are disposed about the concave bottom wall 86 to form a recess 106 or cavity that receives a similarly configured peripheral portion 88 of the fastener 90. The first projections 84 are substantially radial, triangular configured "teeth" that extend from an edge 108 formed at the bottom of the aperture 104 to a "saw tooth" configured bottom edge 110. The configuration of the first projections 84 may be altered to include the same arcuate cutting edge 48 as described above for the lineal projections 14, and the same arcuate edge 52 as described above for the arcuate projections 40 and 42 of the fastener engagement member 12 of the fastener impact driver device 10 (see FIGS. 4–20). Arcuately configured first projections 84 facilitate the removal or insertion of the fastener 90 from or into a workpiece. Arcuately configured first projections reduce deformation of the projections as the first fastener engagement member 82 transfers rotary motion to the fastener 90 thereby increasing the quantity of rotary motion transferred before the projections break away from fastener 20.

Referring to FIGS. 25–28, the first projections 84 include a substantially lineal cutting edge 116 that "cuts" into the surface of the fastener head 114 when the first fastener engagement member 82 receives a driving force thereupon. The configuration of the cutting edge 116 is generally smooth and continuous, but the edge 116 may include serrations to promote the "sawing" of the edge 116 into the fastener head 114. The cutting edge 116 may be used to rotate most fastener heads protruding above the surface of a workpiece. The lineal cutting edge 116 will grasp less of the fastener head 114 as the configuration of the head 114 becomes more round thus reducing the amount of rotational force that may be applied to the fastener 90.

The first projections 84 may be arcuate with an arcuate cutting edge to facilitate increased engagement between the arcuate cutting edge and a substantially round or oval fastener head 114. The first projections 84 are radially disposed relative to the annular peripheral portion 108 when taking a bottom view of the first fastener engagement member 82. The arcuate configuration of the first projections 84 promote the insertion of the edge into a rounded fastener head 114. The more oval the head configuration, the more arcuate the first projection thereby providing sufficient engagement between the first projections and the fastener head 114 to promote the rotation of the fastener 90 into or out of a workpiece.

Referring to FIGS. 23–28, the first fastener engagement member 82 includes a beveled portion 120 that serves the same function as the beveled portion 54 described above. More specifically, the beveled portion 120 prevents any lower portion of the first engagement member 82 from engaging a workpiece before the first projections 84 are inserted into the fastener 90 thereby promoting sufficient engagement between the first projections 84 and the fastener head 114. Furthermore, the beveled portion 120 promotes flexibility in the lower portions of the first fastener engagement member 82. As the arcuate cutting edges of the first projections 84 gouge into the peripheral portion 88 of the fastener head 114, the beveled portion 120 allows the annular bottom edge 122 to expand radially outward from the axis of the first engagement member 82 thereby forcing the cutting edges of the first projections 84 to congruently engage corresponding portions of the fastener head 114 even with the initial configuration of the cutting edges 118 being relatively dissimilar to the configuration of the fastener head 114. The congruent engagement between the cutting edges and the fastener head 114 increases the "grip" of the first fastener engagement member 82 upon the fastener head 114 to promote the insertion or removal of the fastener 90. Should the configurations of the cutting edges and the fastener head 114 be substantially dissimilar, the annular bottom edge 122 will not expand sufficiently to promote congruent engagement between the cutting edges and the fastener head 114. The expanding bottom edge 122 will also promote congruent engagement between the arcuate cutting edges of the first arcuately configured projections. The lineal cutting edges of the first projections 84 will limit expansion of the annular bottom edge 122 thus reducing engagement between the first projections 84 and a corresponding fastener head 114 thereby proportionately reducing the amount of rotary motion that may be transferred from the first fastener engagement member 82 and the fastener 90.

Referring to FIGS. 29–32, the second fastener engagement member 92 is fabricated from a rigid, non-deformable material such as steel. The second fastener engagement member 92 includes a substantially square protuberance, when taking a bottom view, that snugly inserts through the similarly configured aperture 104 in the first fastener engagement member 82 to promote engagement between the second projections 94 of the lower portion 96 of the second fastener engagement member 92 and the central portion 98 of the fastener head 114. Further, the cooperating square configurations transfer rotary motion from the second fastener engagement member 92 to the first fastener engagement member 82. The protuberance 124 is axially dimensioned to extend from the top wall 87 of the first fastener engagement member 82 to the central portion 98 of the fastener head 114 such that the second projections 94 will be urged into the central portion 98 a predetermined dimension when sufficient force (such as a hammer strike) is imparted upon the top wall 102 of the second fastener engagement member 92. The imbedded second projections 94 "grasp" the central portion 98 of the fastener head 114 thereby increasing the rotational motion imparted upon the fastener 90 when a hand tool rotates the second fastener engagement member 92.

The second fastener engagement member 92 further includes an axially disposed recess 126 having a substantially square configuration, when taking a top view, and dimensioned laterally and longitudinally to cooperatively receive a comparably configured protuberance 128 extending from a bottom wall 129 of a positioning member 130 or alternatively, to cooperatively receive a hand tool protuberance (not pictured). The recess 126 allows rotational force to be imparted upon the second fastener engagement member 92 (and ultimately to the first fastener engagement member 82 and the fastener 90) after a hammer or similar object strikes the top wall 102 of the second fastener engagement member 92 thus forcibly driving the first and second projections 84 and 94 into cooperating portions 88 and 98 of the fastener head 114. Some fasteners 90 resist the insertion of the first and second projections 84 and 94 into the fastener head 114 unless a great amount of force is impacted upon the top wall 102 of the second fastener engagement member 92 which can damage the member 92. To prevent this from occurring, a positioning member 130 is placed upon the top wall 102 of the second fastener engagement member 92.

Referring to FIGS. 33–36, a positioning member 130 fabricated from steel includes a cylindrical side wall 132, a planar top wall 134, a planar bottom wall 129 and an axially disposed, substantially square configured protuberance 128 extending therefrom. The protuberance 128 is snugly inserted into the recess 126 of the second fastener engagement member 92 thereby maintaining the position of the positioning member 130 relative to the second fastener engagement member 92 when a hammer or similar force strikes the top wall 134 of the positioning member 130. The positioning member 130 is a solid piece of metal that resists damage while protecting the second fastener engagement member 92. Upon inserting the first and second projections 84 and 94 into the fastener head 114, the positioning member 130 is removed and a square configured protuberance from a hand tool inserted into the recess 126 thereby providing rotary motion to the peripheral and central portions 88 and 98 of the fastener head 114. When the fastener 90 is being removed and a sufficient quantity of the fastener 90 has been extracted from a workpiece, less rotary motion is required to totally remove the fastener 90 from the workpiece. Thus, the second fastener engagement member 92 may be removed from the first fastener engagement member 82, and the hand tool protuberance inserted into the aperture 104 in the first member 82 thereby simplifying the extraction of the fastener 90 by utilizing only the first fastener engagement member 82 to remove the fastener 90.

In operation, the alternative fastener impact driver device 80 is utilized when a fastener head 114 (in particular a one way fastener head) is configured, deformed, corroded or otherwise damaged to such a degree that the fastener impact driver device 10 described above provides insufficient engagement and/or gripping capability between the fastener engagement member 12 and the fastener head 114 thereby failing to rotate and extract the fastener 90 from a workpiece. When utilizing the alternative fastener impact driver device 80, the user first selects one of a plurality of sequentially sized first fastener engagement member 82. The selected first fastener engagement member 82 is configured and dimensioned to cause first projections 84 of the first member 82 to engage a peripheral portion 88 of the fastener head 114. The first fastener engagement member 82 is then set upon the fastener head 114. The user then selects one of a plurality of sequentially sized second fastener engagement members 92. The selected second fastener engagement member 92 is configured and dimensioned to cause second projections 94 of the second member 92 to engage a central portion 98 of the fastener head 114, and to cause a bottom wall 100 of the second member 92 to engage a top wall 87 of the first member 82 irrespective of the configuration of the fastener head 114. The second fastener engagement member 92 includes a protuberance 124 that snugly inserts into and through an aperture 104 that extends through the first fastener engagement member 92 to maintain the axial position of the second member 92 upon the first member 82 and to allow the second projections 94 to engage the central portion 98 of the fastener head 114. Upon disposing the second member 92 upon the first member 82, a positioning member 130 having a protuberance 128 extending from a bottom wall 129, is axially aligned with and secured to the second member 92 when the protuberance 128 is snugly inserted into an axially aligned recess 126 in a top wall 102 of the second member 92. A hammer is then struck upon the top wall 134 of the positioning member 130 until the first projections 84 of the first fastener engagement member 82 and the second projections 94 of the second fastener engagement member 92 sufficiently penetrate respective peripheral and central portions 88 and 98 of the fastener head 114 to facilitate the removal of the fastener 90 from a workpiece. The positioning member 130 is removed from the second fastener engagement member 92 and a hand tool having a substantially similar protuberance extending therefrom is snugly inserted into the recess 126 in the second member 92. The user then rotates the hand tool such that rotary motion is imparted upon the second member 92 which in turn imparts rotary motion upon the first member 82 thereby causing the first and second projections 84 and 94 to impart rotary motion upon the fastener head 114 to extract the fastener 90 from a workpiece.

Although the above description details the removal of a fastener 90 from a workpiece, the alternative fastener impact driver device 80 can also be used to tighten or insert fasteners having varying head configurations into a workpiece. Further, a third fastener engagement member could be added by reducing the dimensions of the first and second engagement members thus promoting smaller fastener engagement surfaces to facilitate more engagement between predetermined portions of the fastener head and corresponding projections of the three engagement members.

Thus, the foregoing description is for purposes of illustration only and is not intended to limit the scope of protection accorded this invention. The scope of protection is to be measured by the following claims, which should be interpreted as broadly as the inventive contribution permits.

The invention claimed is:

1. A device for imparting rotary motion upon a fastener comprising:

a first fastener engagement member having an axially disposed aperture, a plurality of first projections disposed about a lower portion, an upper planar portion that ultimately receives a force thereupon that forces said first projections into a corresponding peripheral portion of the fastener, and an exterior circumferentially extending surface having a plurality of flat regions; and a second fastener engagement member having a plurality of second projections disposed about a bottom portion to engage a central portion of the fastener, a peripheral planar lower portion that engages said upper planar portion of said first fastener engagement member, and an upper planar portion that ultimately receives a force thereupon that forces said first and second projections into corresponding peripheral and central portions of the fastener, said bottom portion of said second fastener engagement member extending axially through an aperture in said first fastener engagement member to ultimately engage the central portion of the fastener.

2. The device of claim 1 wherein said upper planer portion of said second fastener engagement member includes means for removably receiving a positioning member thereupon.

3. The device of claim 2 wherein said means for removably receiving includes an axially disposed recess.

4. The device of claim 2 wherein said positioning member includes an axially disposed protuberance configured to cooperate with a recess in said upper planer portion of said second fastener member such that an axial orientation of said positioning member relative to said second fastener engagement member is maintained irrespective of the quantity of force ultimately imparted upon said upper portion of said positioning member.

5. The device of claim 1 wherein said first projections are configured to rotationally penetrate corresponding portions of the fastener such that said first fastener engagement member may impart force upon the peripheral portion of the fastener.

6. The device of claim 1 wherein said second projections are configured to axially penetrate corresponding portions of the fastener such that said second fastener engagement member may impart force upon the central portion of the fastener.

7. The device of claim 6 wherein said second projections are pyramid configured.

8. The device of claim 1 wherein said plurality of flat regions define a hexagonal cross section.

9. A method for engaging multiple portions of a fastener, said method comprising the steps of:

providing a first fastener engagement member having an axially disposed aperture, a plurality of first projections disposed about a lower portion, said first projections engaging a peripheral portion of the fastener, an upper planar portion that ultimately receives a force thereupon that forces said first projections into a corresponding peripheral portion of the fastener, and an exterior circumferentially extending surface having a plurality of flat regions; and providing a second fastener engagement member having a plurality of second projections disposed about a bottom central portion to engage a central portion of the fastener, a peripheral planar lower portion that engages said upper planar portion of said first fastener engagement member, and an upper planar portion that ultimately receives a force thereupon that forces said first and second projections into corresponding peripheral and central portions of the fastener, said bottom central portion of said second fastener engagement member extending axially through said aperture of said first fastener engagement member to ultimately engage the central portion of the fastener.

10. The method of claim 9 wherein the step of providing a second fastener engagement member having an upper planar portion includes the step of providing means for removably receiving a positioning member thereupon.

11. The method of claim 10 wherein the step of providing means for removably receiving a positioning member includes the step of providing an axially disposed recess.

12. The method of claim 11 wherein the step of providing means for removably receiving a positioning member includes the step of providing said positioning member with an axially disposed protuberance configured to cooperate with said recess.

13. The method of claim 11 wherein the step of providing first projections includes the step of configuring said first projections to rotationally penetrate corresponding portions of the fastener such that said first fastener engagement member may impart rotational force upon said peripheral portion of the fastener.

14. The method of claim 11 wherein the step of providing second projections includes the step of configuring said second projections to axially penetrate corresponding portions of the fastener such that said second fastener engagement member may impart rotational force upon said central portion of the fastener.

15. The method of claim 14 wherein the step of configuring said second projections includes the step of configuring said second projections to include a relatively large base and a relatively pointed top.

16. The device of claim 9 wherein said plurality of flat regions define a hexagonal cross section.

17. A device for imparting rotary motion upon a fastener comprising:

a first fastener engagement member having an axially disposed aperture, a plurality of first projections disposed about a lower portion, and an exterior circumferentially extending surface having a plurality of flat regions; and a second fastener engagement member having a plurality of second projections disposed about a bottom portion to engage a central portion of the fastener, said bottom portion of said second fastener engagement member extending axially through an aperture in said first fastener engagement member to ultimately engage the central portion of the fastener and said second fastener engagement member having an upper planar portion that ultimately receives a force thereupon that forces said first and second projections into corresponding peripheral and central portions of the fastener, said upper planar portion of said second fastener engagement member includes means for removably receiving a positioning member thereupon.

18. The device of claim 17 wherein said means for removable receiving includes an axially disposed recess.

19. The device of claim 17 wherein said positioning member includes an axially disposed protuberance configured to cooperate with said recess in said upper planer portion of said second fastener member such that the axial orientation of said positioning member relative to said second fastener engagement member is maintained irrespective of the quantity of force ultimately imparted upon said upper portion of said positioning member.

20. The device of claim 17 wherein said first projections are configured to rotationally penetrate corresponding portions of the fastener such that said first fastener engagement member may impart rotational force upon the peripheral portion of the fastener.

21. The device of claim 17 wherein said second projections are configured to axially penetrate corresponding portions of the fastener such that said second fastener engagement member may impart rotational force upon the central portion of the fastener.

22. The device of claim 17 wherein said plurality of flat regions define a hexagonal cross section.

* * * * *